US009360798B2

(12) United States Patent
Amauchi et al.

(10) Patent No.: US 9,360,798 B2
(45) Date of Patent: Jun. 7, 2016

(54) DEVELOPER REPLENISHING APPARATUS AND IMAGE FORMING APPARATUS WITH ROTATIONAL VELOCITY CONTROL

(71) Applicant: CANON KABUSHIKI KAISHA, Tokyo (JP)

(72) Inventors: Yuki Amauchi, Kashiwa (JP); Takahiro Kobayashi, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/018,502

(22) Filed: Sep. 5, 2013

(65) Prior Publication Data

US 2014/0079414 A1 Mar. 20, 2014

(30) Foreign Application Priority Data

Sep. 14, 2012 (JP) ..... 2012-202948
Jul. 26, 2013 (JP) ..... 2013-155213

(51) Int. Cl.
*G03G 15/00* (2006.01)
*G03G 15/08* (2006.01)

(52) U.S. Cl.
CPC ..... *G03G 15/0877* (2013.01); *G03G 15/0872* (2013.01); *G03G 15/0879* (2013.01)

(58) Field of Classification Search
CPC ..... G03G 15/0834; G03G 15/0837; G03G 15/0877; G03G 15/0872; G03G 15/0879
USPC ..... 399/27, 258, 260
See application file for complete search history.

(56) References Cited

U.S. PATENT DOCUMENTS 5,287,151 A * 2/1994 Sugiyama ..... 399/258
5,369,478 A 11/1994 Kobayashi et al.

(Continued)

FOREIGN PATENT DOCUMENTS

EP 1 973 009 A2 9/2008
EP 1 973 009 B1 10/2010

(Continued)

OTHER PUBLICATIONS

English Machine Translation of Nakajima, Nobuo. Developer Replenishment Container. Sep. 24, 2010. Japanese Patent Office. JP5132611/JP2010210946.*

(Continued)

*Primary Examiner* — Clayton E Laballe
*Assistant Examiner* — Trevor J Bervik
(74) *Attorney, Agent, or Firm* — Fitzpatrick, Cella, Harper & Scinto

(57) ABSTRACT

A replenishing apparatus includes a rotatable cylindrical-shaped container having a discharge opening through which toner is discharged, and a guide member provided rotatably with the container. The guide member has a first face on an inner face of the container and a second face which guides the toner scooped by the first face toward the discharge opening. A controller controls a drive portion to rotate the container in a first mode that performs replenishment control in a first drive condition and in a second mode that performs replenishment control in a second drive condition in which a quantity of rotation of the container per unit time is less than the first drive condition. The controller switches the mode from the first mode to the second mode based on a detection result about a quantity of developer.

3 Claims, 25 Drawing Sheets

(56) References Cited

U.S. PATENT DOCUMENTS

| | | | | |
|---|---|---|---|---|
| 6,289,182 | B1 * | 9/2001 | Umezawa et al. | 399/12 |
| 6,909,869 | B2 | 6/2005 | Yamamoto et al. | |
| 7,116,931 | B2 * | 10/2006 | Yamada et al. | 399/262 |
| 7,315,715 | B2 * | 1/2008 | Tsuda et al. | 399/258 |
| 7,398,038 | B2 * | 7/2008 | Tsuda et al. | 399/262 |
| 7,480,476 | B2 * | 1/2009 | Hosokawa et al. | 399/258 |
| 7,761,015 | B2 * | 7/2010 | Wong | 399/27 |
| 8,280,264 | B2 | 10/2012 | Inoue | |
| 8,498,546 | B2 | 7/2013 | Inoue | |
| 8,861,992 | B2 | 10/2014 | Suzuki | |
| 2003/0219263 | A1 * | 11/2003 | Tsuzuki | 399/27 |
| 2004/0052538 | A1 * | 3/2004 | Yugeta et al. | 399/27 |
| 2006/0051136 | A1 | 3/2006 | Tsuda et al. | |
| 2008/0044204 | A1 * | 2/2008 | Inoue | 399/262 |
| 2012/0219307 | A1 * | 8/2012 | Suzuki | G03G 15/0827 399/27 |
| 2013/0011165 | A1 | 1/2013 | Inoue | |

FOREIGN PATENT DOCUMENTS

| | | | |
|---|---|---|---|
| EP | 1 751 626 | B1 | 2/2013 |
| JP | 08-220862 | A | 8/1996 |
| JP | 2004-184588 | A | 7/2004 |
| JP | 2006-171071 | A | 6/2006 |
| JP | 2008-309995 | A | 12/2008 |
| JP | 2010-210946 | A | 9/2010 |
| JP | 5132611 | B2 | 1/2013 |
| WO | 2005/111734 | A1 | 11/2005 |

OTHER PUBLICATIONS

Japanese Office Action dated Mar. 4, 2014, in related Japanese Patent Application No. 2013-155213 (with English translation).

Chinese Office Action dated Nov. 3, 2015, in related Chinese Patent Application No. 201310408191.0 (with English translation).

* cited by examiner

DURING IMAGE FORMING OPERATION

DURING IMAGE FORMING OPERATION

DURING IMAGE FORMING OPERATION

DEVELOPER REPLENISHING APPARATUS AND IMAGE FORMING APPARATUS WITH ROTATIONAL VELOCITY CONTROL

BACKGROUND OF THE INVENTION

1. Field of the Invention

The present invention relates to an image forming apparatus such as a copying machine, a facsimile, and a printer that forms an electrostatic image on an image bearing member, for example, by an electrophotographic system, an electrostatic recording system and the like to convert the electrostatic image into a visible image (toner image) by a developer contained in a developing device. In particular, the invention relates to an image forming apparatus to which the developer is replenished by rotation of a developer replenishment container, and a developer replenishing apparatus.

2. Description of the Related Art

An image forming apparatus, in which a developer (toner) is supplied to a developing device by rotating a cylindrical developer replenishment container in a laying-down state, has been put to practical use.

The presence or absence of the developer is determined by a developer detection sensor provided in a developer accommodation portion of a developer replenishing apparatus included in the image forming apparatus, and the enough developer to be used in the developing device is supplied from the developer replenishing apparatus. When the developer in the developer accommodation portion decreases, the "absence of developer" is determined by the developer detection sensor, and the developer replenishment container rotates. When the developer replenishment container rotates, the developer is replenished to the developer replenishing apparatus from a discharge opening portion, and when "the presence of developer" is determined by the developer detection sensor, the rotation of the developer replenishment container stops. During the replenishment operation of the developer, the developer replenishment container is continuously rotating.

Japanese Patent Laid-Open No. 2010-210946 discloses a configuration that has a discharge opening portion with an inner diameter smaller than an accommodation portion at one end portion of a cylindrical developer replenishment container, a developer in the developer replenishment container moves to the discharge opening portion side in accordance with the rotation of the developer replenishment container, and then the developer in the developer replenishment container is scooped up and conveyed to the discharge opening portion, by a conveying portion which rotates integrally with the developer replenishment container. By having the conveying portion, the developer remaining inside the container is reduced, without exceeding the height of the discharge opening portion.

In the configuration in which toner is scooped up and conveyed to the discharge opening portion by the conveying portion which rotates integrally with the cylindrical container as described above, the conveying portion has roles (a) and (b) described below. That is, there are (a) a role of scooping the developer accumulated near the discharge opening portion by a scooping portion, and (b) a role of conveying the scooped developer to the discharge opening portion, by sliding down a guide portion due to the own weight of the developer.

Moreover, in a case where the conveying portion rotates as described above, the developer existing in the container during a replenishment operation is broadly divided into (1) a developer that is scooped up and conveyed to the discharge opening portion by the conveying portion, and (2) a developer that remains in the container and is not conveyed to the discharge opening portion.

When classifying the developer described in (2), although the developer is scooped up by the conveying portion, there are a spilled developer, a developer that spills, rebounds, and floats in the container again, and a developer that starts to float by the impact of the spilled developer.

In the developer replenishment container having the conveying portion that scoops up the developer within the container as described above, when there is a large quantity of developer in the container, there is also a large quantity of developer accumulated in the discharge opening portion. Thus, it is possible to scoop up a lot of developer by one scooping operation (the role (a) of the conveying portion). Since the scooped developer slides down the guide portion and is conveyed at this time, a quantity of discharge also increases (the role (b) of the conveying portion). Since the scooping operation per unit time and the number of times, in which the developer slides down and is discharged, increase by performing the replenishment operation by the continuous rotation, the quantity of discharge increases. When the quantity of developer in the developer replenishment container is large, discharging properties are satisfactory by performing the replenishment operation by the continuous rotation.

On the other hand, when the quantity of developer in the container is small, that is, when there are many hollow portions inside the container, if the replenishment operation is continuously performed, the developer in the container is constantly stirred by the rotation of the container main body and the conveying portion, and thus a quantity of floating developer increases. As a result, since the quantity of developer to be scooped up by the scooping operation decreases, and the quantity of developer that slides down and is conveyed also decreases, discharging properties are lowered, and the quantity of developer remaining inside the container increases. Further, since the quantity of floating developer is unstable, the quantity of developer remaining inside the container varies. The increase and the variation of quantity of developer remaining inside the container become a problem because it leads to an increase in running costs.

SUMMARY OF THE INVENTION

It is desirable to provide a developer replenishing apparatus and an image forming apparatus capable of suppressing and reducing the variation in the quantity of developer remaining in the container.

A replenishing apparatus according to the present invention includes: a container which accommodates developer and is capable of discharging the developer by rotating; a guide portion which is provided so as to be rotatable with the container, and is able to scoop up the developer of a bottom portion of a first region in the container and guide the developer to a second region in which a height of a bottom surface is higher than the first region; a drive portion which rotates the container; a receiving portion which receives the developer discharged from the container; a detection portion which detects information about a quantity of developer within the receiving portion; and a controller which controls the drive portion based on a detection result of the detection portion, wherein the apparatus is able to execute, as drive conditions of the drive portion, a first mode that performs the replenishment control in a first drive condition, and a second mode that executes the replenishment control in a second drive condition in which a quantity of rotation of the container per unit time is less than the first drive condition, and the controller switches the mode from the first mode to the second mode, based on the detection result of the detection portion.

Further features of the present invention will become apparent from the following description of exemplary embodiments with reference to the attached drawings.

DESCRIPTION OF THE EMBODIMENTS

[First Embodiment] Exemplary embodiments of the invention will be illustratively described below in detail with reference to the drawings. However, as long as not described specifically in particular, a dimension, a material, a shape, a relative arrangement and the like of constituent components described in this embodiments are not intended to limit the scope of the invention only thereto.

<Overall Configuration of Image Forming Apparatus>

Figure 1:
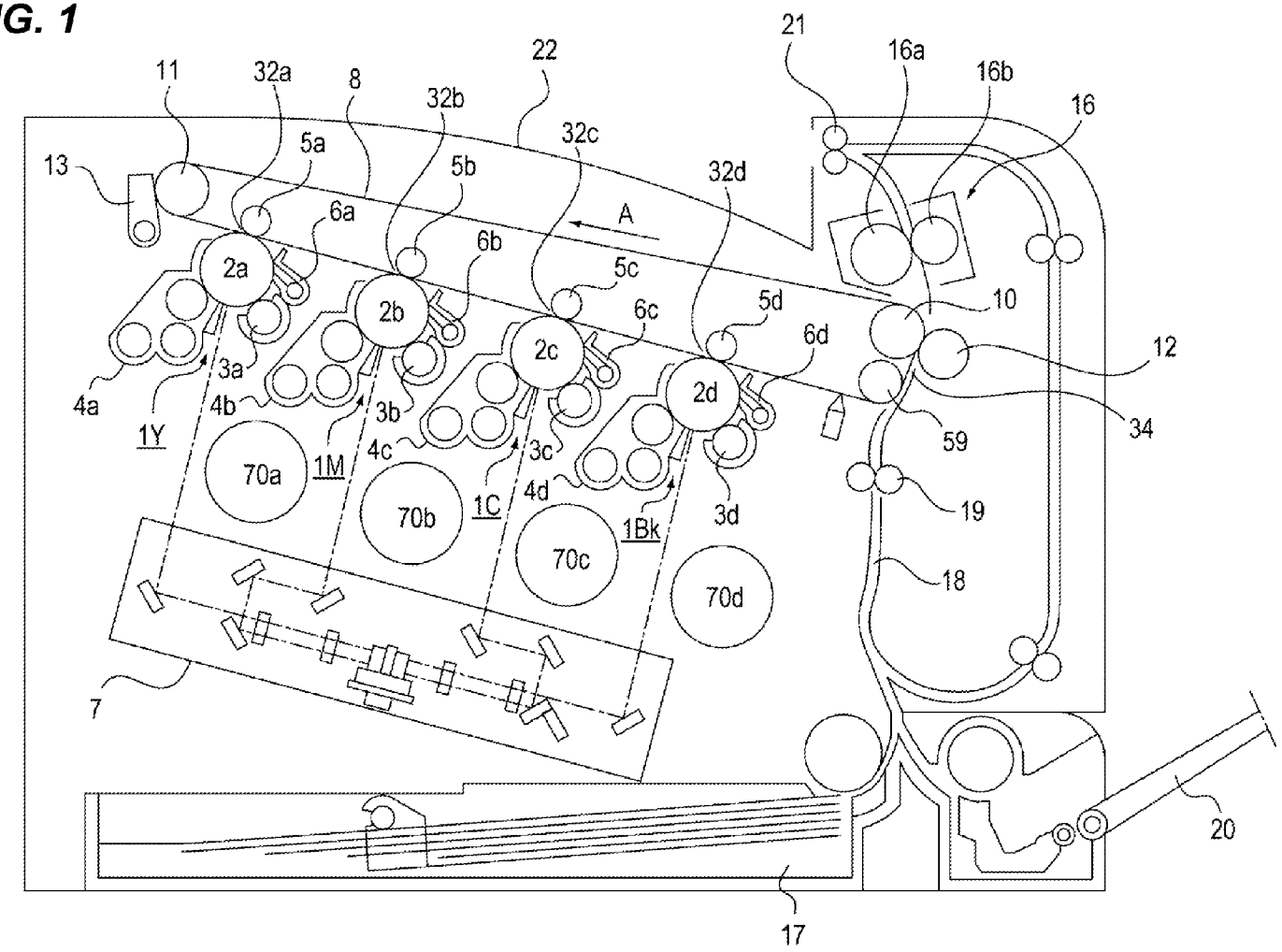
FIG. 1 is a schematic configuration diagram illustrating an embodiment of an image forming apparatus.

FIG. 1 is a schematic configuration diagram illustrating an example of a full-color image forming apparatus (full-color printer) having an inline type intermediate transfer belt (intermediate transfer portion) in an electrophotographic system of the embodiment.

The image forming apparatus includes four image forming portions (image forming stations) of an image forming portion 1Y configured to form an image of yellow color, an image forming portion 1M configured to form an image of magenta color, an image forming portion 1C configured to form an image of cyan color, and an image forming portion 1Bk configured to form an image of black color, and the four image forming portions 1 (1Y, 1M, 1C, 1Bk) are arranged in a row at regular intervals.

In each image forming portion 1, a drum-type electrophotographic photoreceptor (hereinafter, referred to as photosensitive drum) 2 (2*a*, 2*b*, 2*c*, 2*d*) is installed as an image bearing member. A primary charger 3 (3*a*, 3*b*, 3*c*, 3*d*), a developing device 4 (4*a*, 4*b*, 4*c*, 4*d*), a transfer roller 5 (5*a*, 5*b*, 5*c*, 5*d*) as a transfer portion, and a drum cleaning device 6 (6*a*, 6*b*, 6*c*, 6*d*) are disposed around each photosensitive drum 2, and a laser exposure device 7 is disposed on the lower side between the primary charger 3 and the developing device 4.

A yellow toner, a cyan toner, a magenta toner, and a black toner are respectively accommodated in the developing devices 4*a*, 4*b*, 4*c*, and 4*d*.

Each photosensitive drum 2 is a negatively chargeable OPC photoreceptor, has a photoconductive layer on a drum substrate made of aluminum, and is rotated and driven at a predetermined process speed by a driving device (not illustrated).

The primary charger 3 as the primary charging portion uniformly charges the surfaces of each photosensitive drum 2 to a predetermined potential of negative polarity by a charging bias applied from a charging bias power source (not illustrated).

The developing device 4 is equipped with the toner, and attaches the toner of each color to each electrostatic image formed on each photosensitive drum 2 to develop the toner as a toner image (visible image).

The transfer roller 5 as the primary transfer portion is arranged so as to be enable to come into contact with each photosensitive drum 2 via the intermediate transfer belt 8 in each primary transfer portion 32 (32*a*, 32*b*, 32*c*, 32*d*).

The drum cleaning device 6 has a cleaning blade or the like for removing the residual transfer toner remaining on the photosensitive drum 2 at the time of the primary transfer from the photosensitive drum 2.

The intermediate transfer belt 8 is stretched among a secondary transfer counter roller 10, a drive roller 59 and a tension roller 11, and is rotated in a direction of arrow A by the driving input to the drive roller 59. The secondary transfer counter roller 10 is arranged so as to be enable to come into contact with a secondary transfer roller 12 via the intermediate transfer belt 8 by a secondary transfer portion 34. Furthermore, on the outer side of the endless intermediate transfer belt 8, and in the vicinity of the tension roller 11, a belt cleaning device 13 configured to remove and recover the residual transfer toner remaining on the surface of the intermediate transfer belt 8 is installed. Furthermore, a substantially vertical conveying path, in which a fixing device 16 having a fixing roller 16*a* and a pressure roller 16*b* is installed, is formed on the downstream side and the upper side of the conveying direction of a transfer material P than the secondary transfer portion 34.

The exposure device 7 includes a laser beam emitting portion configured to perform the light emission corresponding to a time series electrical digital pixel signal of given image information, a polygon lens, a reflecting mirror and the like, and forms an electrostatic image of each color corresponding to the image information on the surface of each photosensitive drum 2 charged by each primary charger 3, by performing the exposure to each photosensitive drum 2.

Next, the image forming operation using the image forming apparatus described above will be described.

When an image formation starting signal is issued, each photosensitive drum 2 of each image forming portion 1 rotated and driven at a predetermined process speed is negatively charged uniformly by the primary charger 3. Moreover, the exposure device 7 emits a color-separated image signal, which is input from the outside, from the laser beam emitting element to form an electrostatic image of each color on each photosensitive drum 2 via the polygon lens, the reflecting mirror or the like.

Moreover, first, the yellow toner is attached to the electrostatic image formed on the photosensitive drum 2*a*, by the developing device 4*a* to which the developing bias of the same polarity as the charge polarity (negative polarity) of the photosensitive drum 2*a* is applied, to become a visible image as the toner image. The yellow toner image is primarily transferred onto the driving intermediate transfer belt 8 in the primary transfer portion 32*a* between the photosensitive drums 2*a* and the transfer roller 5*a*, by the transfer roller 5*a* to which the primary transfer bias (opposite-polarity to the toner (positive polarity)) is applied.

The intermediate transfer belt 8 to which the yellow toner image is transferred is moved to the image forming portion 1M side. Furthermore, even in the image forming portion 1M, in the same manner as described above, a magenta toner image formed on the photosensitive drum 2*b* is superimposed on the yellow toner image on the intermediate transfer belt 8, and is transferred by the primary transfer portion 32*b*.

At this time, the residual transfer toner remaining on each photosensitive drum 2 can be scraped off by a cleaner blade or the like provided in the drum cleaning device 6, and is recovered.

Hereinbelow, in the same manner, the toner image of cyan and black formed by the photosensitive drums 2*c* and 2*d* of the image forming portions 1C and 1Bk are sequentially superimposed on the toner images of yellow and magenta superimposed and transferred on the intermediate transfer belt 8 by each primary transfer portion 32 to form a full-color toner image on the intermediate transfer belt 8.

Moreover, in accordance with a timing when a leading end of the full-color toner image on the intermediate transfer belt 8 is moved to the secondary transfer portion 34 between the secondary transfer counter roller 10 and the secondary transfer roller 12, the transfer material (sheet) P selected from a sheet cassette 17 or a manual feed tray 20 and fed though a conveying path 18 is conveyed to the secondary transfer portion 34 by a registration roller 19. The full-color toner image is collectively and secondarily transferred to the transfer material P conveyed to the secondary transfer portion 34, by the secondary transfer roller 12 to which the secondary transfer bias (opposite-polarity to the toner) is applied.

The transfer material P formed with the full-color toner image is conveyed to the fixing device 16. After the full-color toner image is heated and pressurized by a fixing nip portion between the fixing roller 16*a* and the pressure roller 16*b* and is thermally fixed onto the surface of the transfer material P, the full-color toner image is discharged onto the discharge tray 22 of the upper surface of the main body by the discharge roller 21, and then a series of image forming operations finishes. In addition, the secondary transfer residual toner or the like remaining on the intermediate transfer belt 8 is removed and recovered by the belt cleaning device 13.

Figure 2:
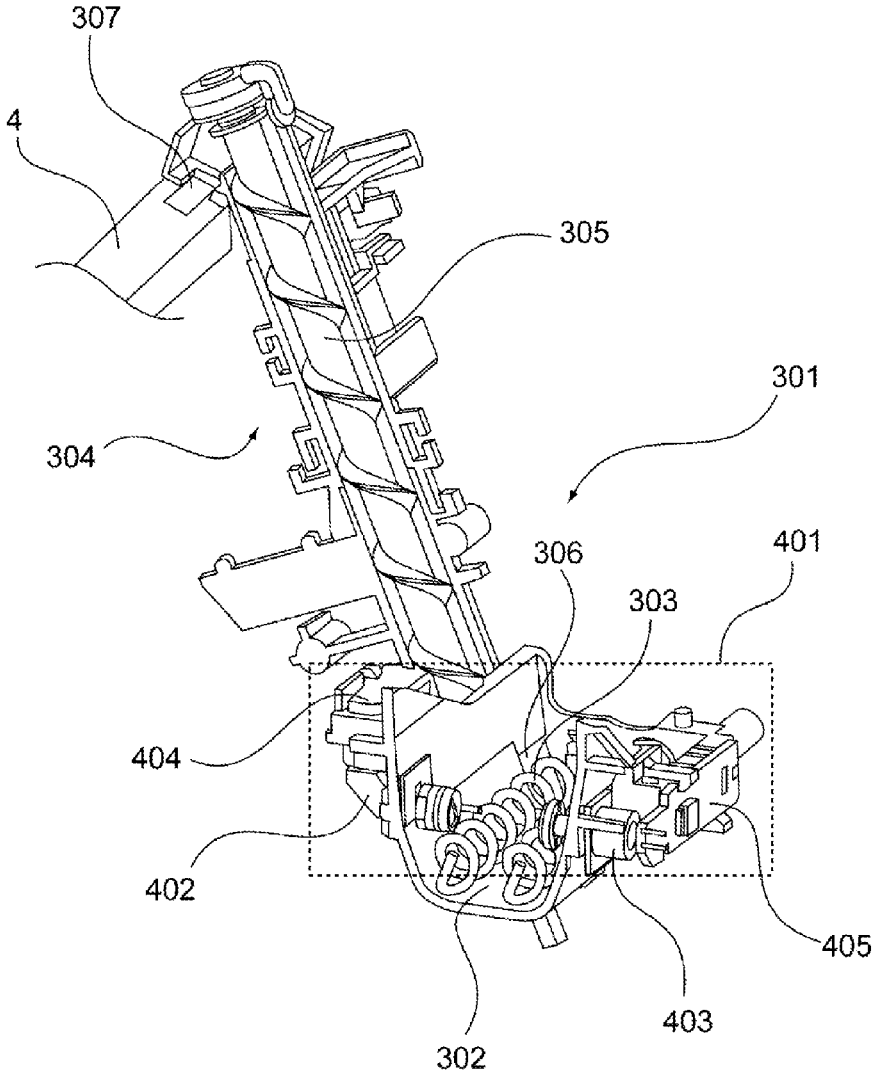
FIG. 2 is an explanatory view illustrating a configuration of a developer replenishing apparatus.
Figure 3A:
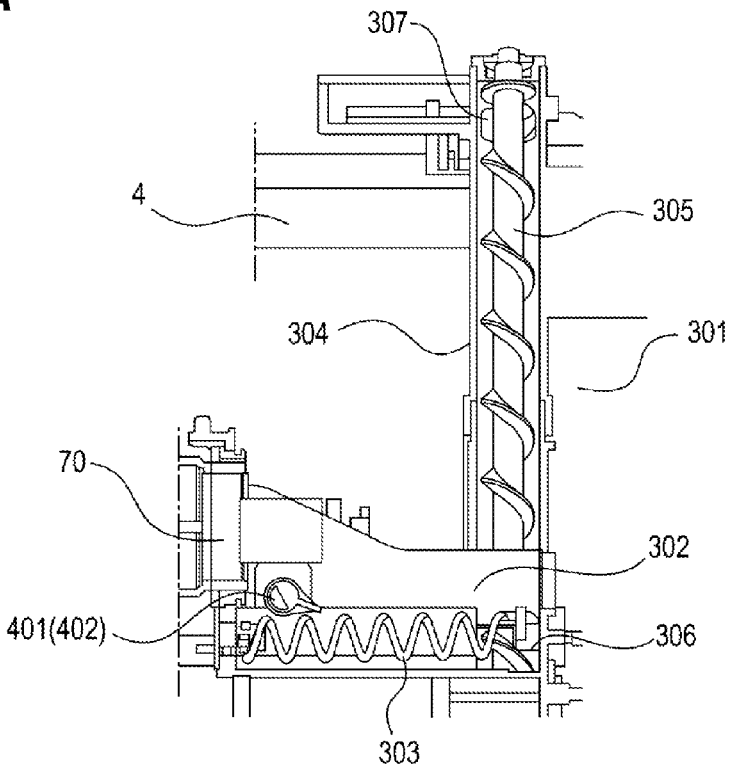
FIGS. 3A and 3B are explanatory views illustrating the configuration of the developer replenishing apparatus.
Figure 3B:
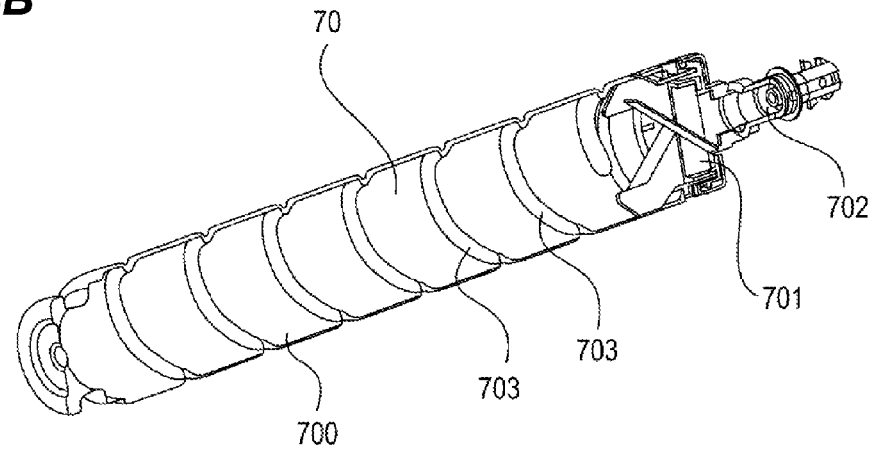
Figure 4:
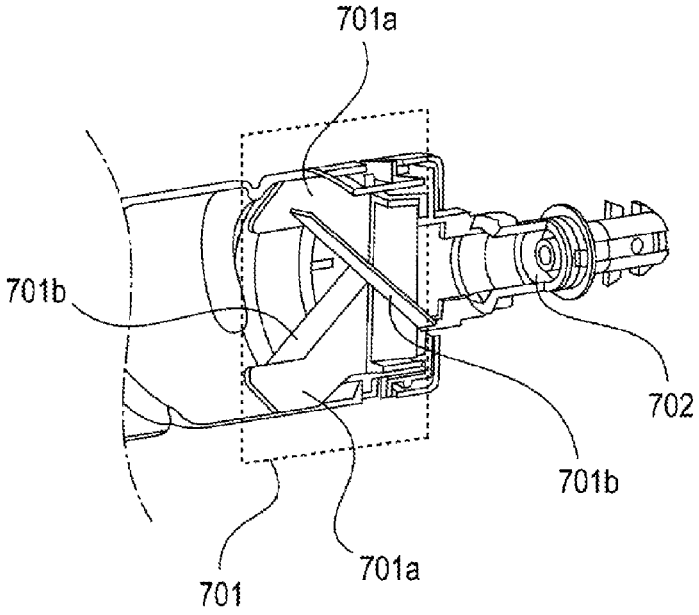
FIG. 4 is an explanatory view illustrating a configuration of toner discharge of a toner bottle.

<Developer Replenishing Apparatus> FIG. 2 is a perspective view illustrating an example of a toner replenishing apparatus, and FIGS. 3A and 3B are cross-sectional views thereof. First, the toner replenishing apparatus configured to supply the toner to the developing device 4 will be described.

A toner replenishing apparatus 301 provided in the image forming apparatus has a toner accommodation portion (buffer portion) 302 that stores the toner replenished from a tubular toner replenishment container 70 (70*a*, 70*b*, 70*c*, 70*d*) in which a plurality of color toners corresponding to each developing device 4 is contained, a toner conveying member 303 that conveys the toner, and a toner residual quantity detection portion 401 that detects the residual quantity of toner in the toner accommodation portion 302 using light.

When shortage of toner is detected by the toner residual quantity detection portion 401 disposed in the toner accommodation portion 302, the toner replenishment container (hereinbelow, referred to as "toner bottle") 70, which is a cylindrical bottle, is rotated and driven by a toner replenishment container drive portion (not illustrated), the toner of the interior is discharged into the toner accommodation portion 302 from a toner discharge port, and the interior of the toner accommodation portion 302 is filled with toner until the toner residual quantity detection portion 401 detects the presence of toner.

The toner supplied into the toner accommodation portion 302 is conveyed to a toner accommodation portion side opening portion 306 by the toner conveying member 303, and is further conveyed to each developing device 4 from a developing device side opening portion 307 by a toner conveying member 305 of the toner conveying portion 304.

(Developer Detection Configuration) Next, the toner residual quantity detection portion 401 configured to detect the residual quantity of toner in the toner accommodation portion 302 will be described. In addition, the detection of the residual quantity of toner of the embodiment is intended to detect the presence or absence of the toner, by detecting the height of the toner supplied to the toner accommodation portion 302.

The toner residual quantity detection portion 401 provided in the toner replenishing apparatus 301 includes a light-emitting portion 404 that emits light, a light-receiving portion 405 that receives the light, a light-emitting side light transmitting member 402 that guides the emitted light into the toner accommodation portion 302, and a light-receiving side light transmitting member 403 that guides light of the toner accommodation portion 302 to the light-receiving portion. An LED of the light-emitting portion 404 of the toner residual quantity detection portion 401 lights on, the detected light passes through the interior of the light-emitting side light transmitting member 402 formed by PS (Polystyrene) or PC (Polycarbonate) of transparent resin, is guided into the toner accommodation portion 302, and is emitted from the vertical exiting surface of the light-emitting side light transmitting member 402. At this time, if there is no toner between the light-emitting side light transmitting member 402 and the light-receiving side light transmitting member 403 disposed to face each other in the horizontal direction, the detected light is incident from a vertical incident surface of the light-receiving side light transmitting member 403 without being blocked, passes through the interior of the light-receiving side light transmitting member 403, and is received by the light-receiving portion 405, and the image forming apparatus detects that a predetermined quantity of toner is not present in the toner accommodation portion 302. Then, the toner bottle 70 is rotated and driven by a toner bottle drive portion (not illustrated), and the toner of the interior is discharged into the toner accommodation portion 302 from the toner discharge port. By repeatedly discharging the toner from the toner bottle 70 and storing the toner in the toner accommodation portion 302 until the detected light is blocked between the light-emitting side light transmitting member 402 and the light-receiving side light transmitting member 403, a predetermined quantity of toner is maintained in the toner accommodation portion 302. In addition, in order to constantly keep the interior of toner accommodation portion 302 at a predetermined quantity of toner, in consideration of responsiveness to the variation of the quantity of toner, it is preferable that the toner residual quantity detection portion 401 be located immediately below the vicinity of the toner discharge port of the toner bottle 70.

As mentioned above, in the toner replenishing apparatus 301, the toner is supplied to the developing device 4 as needed together with the image formation, and the toner is kept at a predetermined quantity of toner by receiving the supply of new toner from the toner bottle 70 based on the detection result of the toner residual quantity detection portion 401. For this reason, by quantitatively supplying the required quantity of toner calculated by a control unit of the image forming apparatus into the developing device 4, it is possible to maintain a mixing ratio between the toner and the magnetic carrier in a predetermined state, in the developing device using a two-component developer, and the stable image formation is possible.

<Toner Discharge Configuration of Toner Bottle> Here, the discharge configuration of toner of the toner bottle 70 will be described with reference to FIGS. 3A to 6. As illustrated in FIGS. 3A and 3B, the toner bottle 70 of the embodiment has a cylindrical container body 700 configured to accommodate the toner, and a developer conveying portion 701 configured to convey the toner in the container main body to a discharge opening portion 702 by rotating integrally therewith. Moreover, a groove 703 having a helical shape is provided on the side surface of the toner bottle 70. With the rotation of the toner bottle 70, the toner is conveyed to the discharge opening portion 702 side along the helical shape.

The toner bottle 70 has a container main body configured to accommodate the toner, and the developer conveying portion 701 configured to convey the toner in the container main body to the discharge opening portion 702 by rotating integrally therewith. The developer conveying portion 701 includes a baffle portion that is rotated together with the toner bottle 70, scoops up the toner located below the opening portion 702 to the upper side than the opening portion 702, and guides the toner into the opening portion 702. In other words, the baffle portion has a guide portion that guides the developer located in the bottom portion of a first region of the toner bottle to the bottom portion of a second region higher than the first region, on the opening portion 702 side of the toner bottle 70.

Specifically, as illustrated in FIGS. 5A to 5D, the conveying portion 701 has a scooping portion 701*a* that is provided in the vicinity of the discharge opening portion 702 to scoop up the toner in the container to the opening portion 702, and a guide portion 701*b* that guides the scooped toner to the opening portion 702.

Figure 5A:
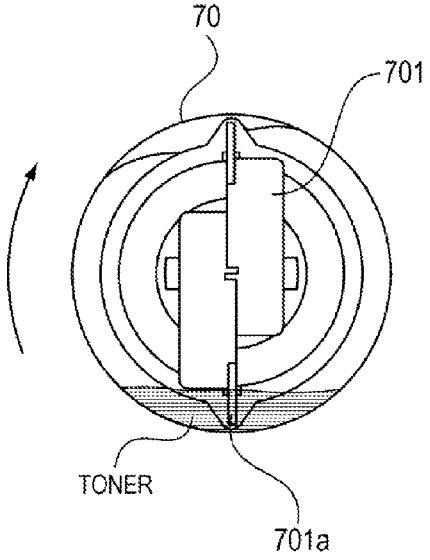
FIGS. 5A to 5D are explanatory views illustrating the toner conveyance using a conveying portion.
Figure 5B:
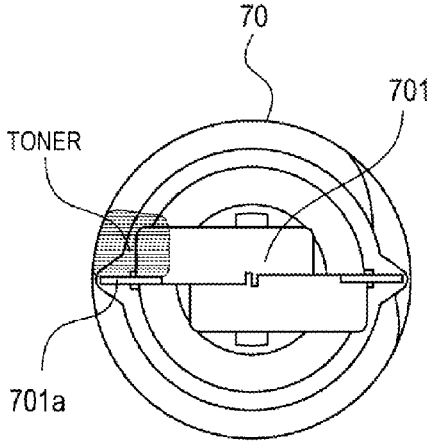
Figure 5C:
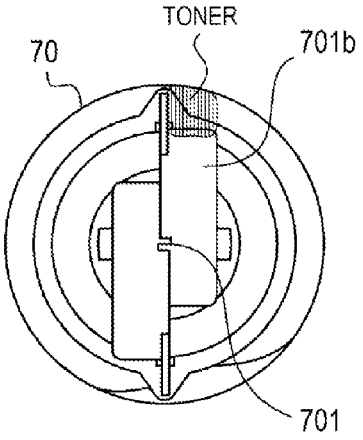
Figure 5D:
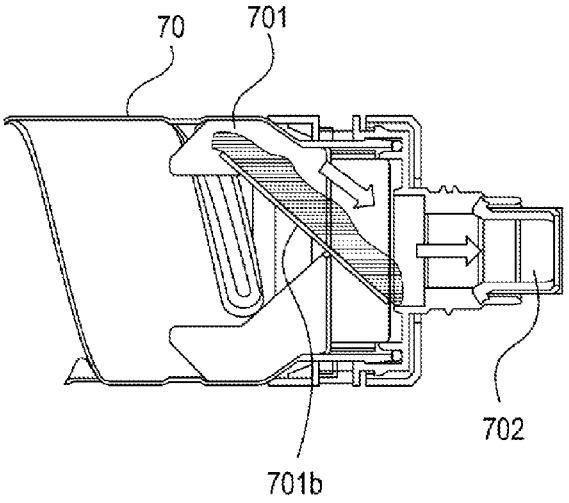
Figure 6:
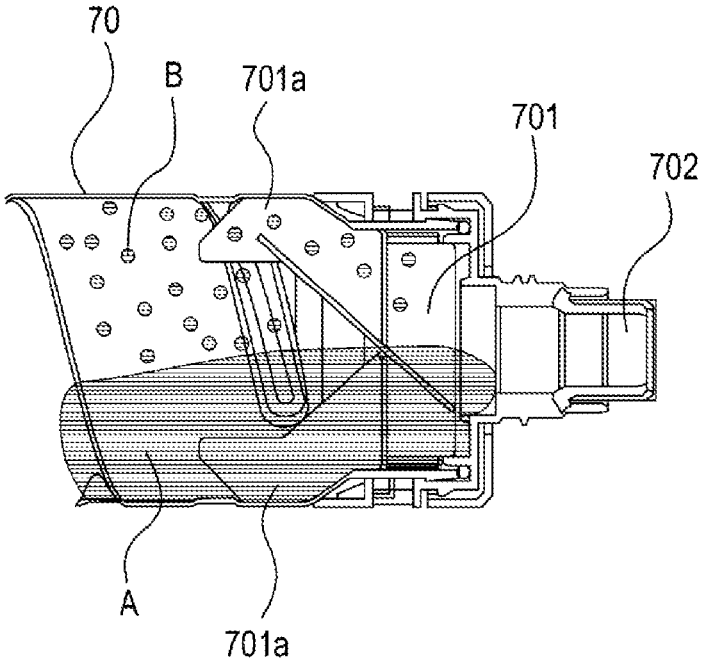
FIG. 6 is an explanatory view of the toner behavior of the interior of the toner bottle.

The toner accumulated near the discharge opening portion 702 along a helical shape is scooped up by the scooping portion 701*a* of the conveying portion 701 that rotates integrally with the toner bottle 70 (FIGS. 5A and 5B), is conveyed toward the discharge opening portion 702 by sliding down the guide portion 701*b*, and is discharged to the toner accommodation portion 302 (FIGS. 5C and 5D). In addition, as illustrated in FIG. 6, as the toner in the toner bottle 70 during the rotation operation of the toner bottle 70, there are a toner B that is stirred and floats by the rotation of the toner bottle 70 and the conveying portion 701, and a toner A that is accumulated near the discharge opening portion 702 and is scooped up by the scooping portion 701*a*.

<Toner Supply Mode from Toner Bottle> Although the image forming apparatus of the embodiment rotates the toner bottle 70 to supply the toner, as driving conditions that rotate the toner bottle 70, there are a first driving condition, and a second driving condition in which a quantity of rotation of the toner bottle per unit time is lower than that of the first driving condition. Thus, as supply modes of the toner, there are a first supply mode in which the toner bottle 70 is rotated under the first driving condition, and a second supply mode in which the toner bottle 70 is rotated under the second driving condition. In the embodiment, the first supply mode is a method that continuously rotates the toner bottle 70, and the second supply mode is a method that intermittently rotates the toner bottle 70. Here, the continuous rotation means an operation that rotates continuously the toner bottle 70 without stopping, and the intermittent rotation means an operation that repeatedly performs the rotation/stop of the toner bottle 70.

Moreover, in the image forming apparatus of the embodiment, when the quantity of toner in the toner bottle is large, since discharging properties of the toner are good, the continuous rotation is performed, and when the quantity of toner in the toner bottle decreases and discharging properties of the toner become worse, the intermittent rotation is performed in which the scoop-up interval using the scooping portion 701*a* becomes longer than the continuous rotation.

(Toner Discharge Due to Continuous Rotation of Toner Bottle) First, when the toner bottle 70 is continuously rotated, discharging properties of the toner will be described with reference to FIGS. 7A to 8B.

Figure 7A:
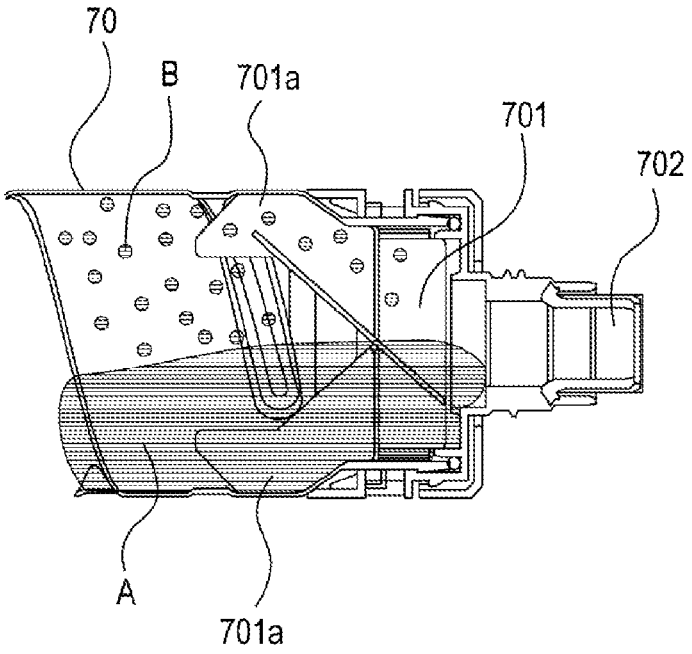
FIGS. 7A and 7B are explanatory views (large quantity of toner) illustrating the toner behavior of the interior of the toner bottle.
Figure 7B:
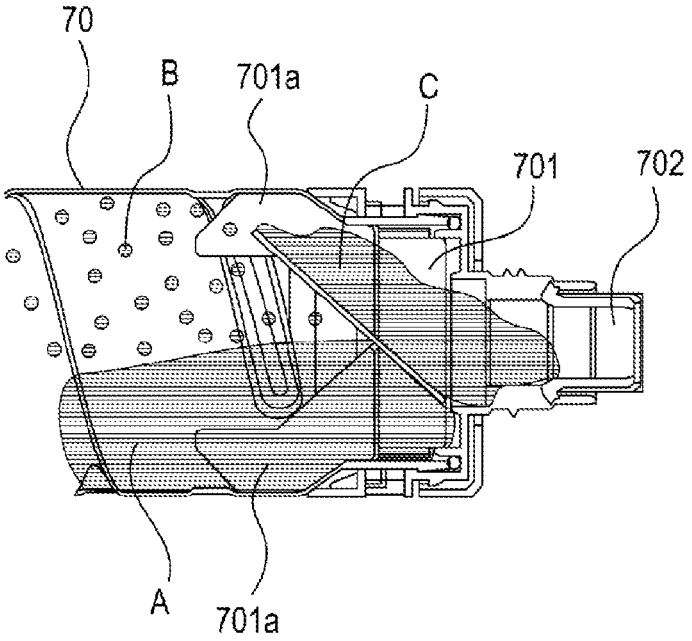

As illustrated in FIGS. 7A and 7B, when the quantity of toner in the toner bottle is large, as the toner in the toner bottle, there is the toner B stirred and floating by the rotation of the toner bottle 70 and the conveying portion 701, but there is also a lot of toner A accumulated near the opening portion of the toner bottle 70. For this reason, it is possible to scoop up a sufficient quantity of toner by the scooping portion 701*a* of the conveying portion 701. Since the scooped-up toner is conveyed and discharged to the discharge opening portion 702 by sliding down the guide portion 701*b*, the quantity of discharge to the toner accommodation portion 302 is also large (C of FIG. 7B).

As the image formation is repeatedly performed and the number of times of the discharge from the toner bottle 70 to the toner accommodation portion 302 increases, the quantity of toner in the toner bottle decreases.

Figure 8A:
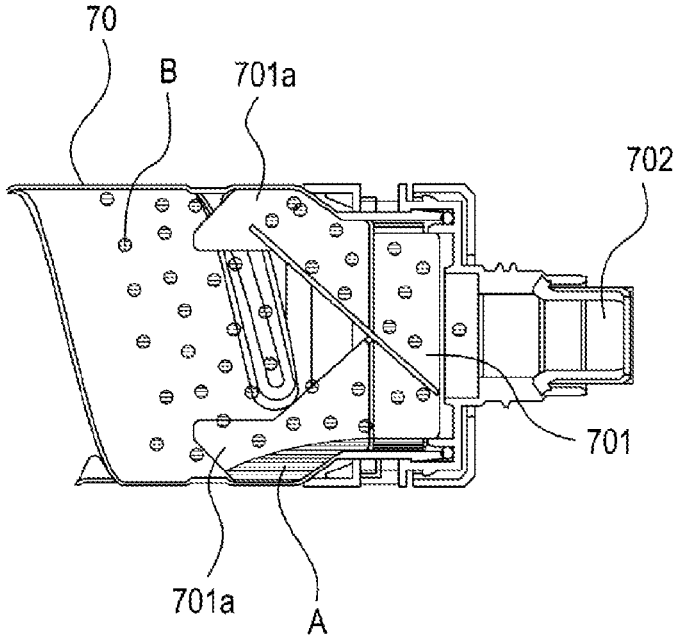
FIGS. 8A and 8B are explanatory views (small quantity of toner) of the toner behavior of the interior of the toner bottle.
Figure 8B:
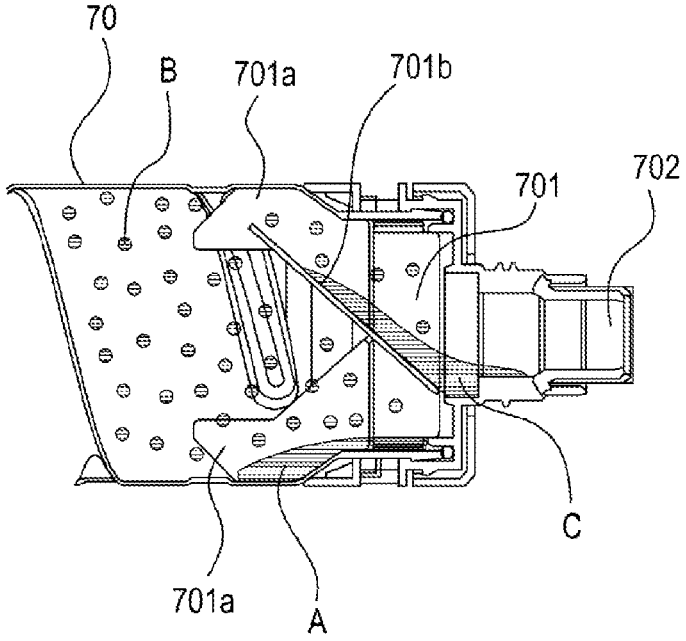

As illustrated in FIGS. 8A and 8B, when the quantity of toner in the toner bottle 70 decreases, in addition to a decrease in the total quantity of the toner in the toner bottle 70, since there is the toner B that is stirred and floats by the rotation of the toner bottle 70 and the conveying portion 701, the toner A accumulated near the opening portion of the toner bottle 70 decreases. For this reason, the toner scooped up by the scooping portion 701*a* of the conveying portion 701 decreases. Since the scooped toner is conveyed and discharged to the discharge opening portion 702 by sliding down by the guide portion 701*b*, the quantity of discharge to the toner accommodation portion 302 also decreases (C of FIG. 8B). As the residual quantity of toner in the toner bottle 70 decreases, since the quantity of discharge to the toner accommodation portion 302 also decreases, eventually, the toner is hardly discharged.

(Toner Discharge Due To Intermittent Rotation of Toner Bottle) According to the image forming apparatus of the embodiment, even when the toner bottle 70 continuously rotates for a predetermined time, in a case where the presence of toner is not detected by the toner residual quantity detection portion in the toner accommodation portion 302, it is determined that the residual quantity of toner in the toner bottle 70 is small. Moreover, in that case, the toner bottle 70 is switched to the intermittent rotation.

Figure 9A:
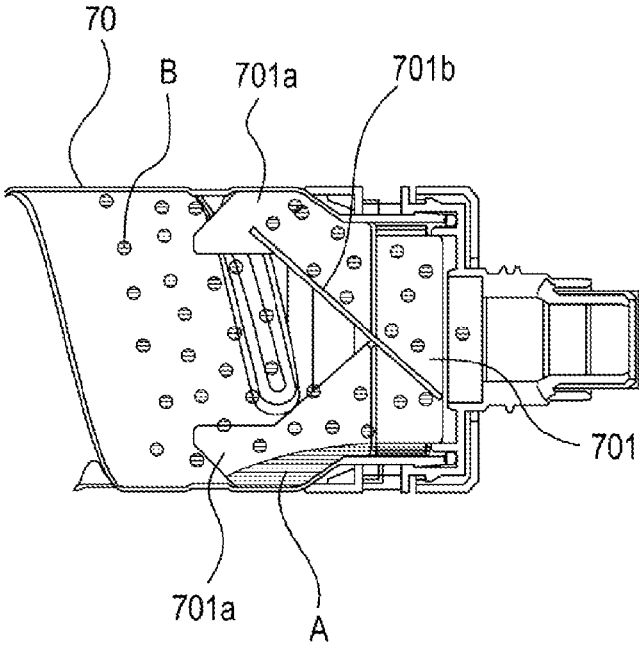
FIGS. 9A and 9B are explanatory views (at the time of intermittent rotation) of the toner behavior of the interior of the toner bottle.
Figure 9B:
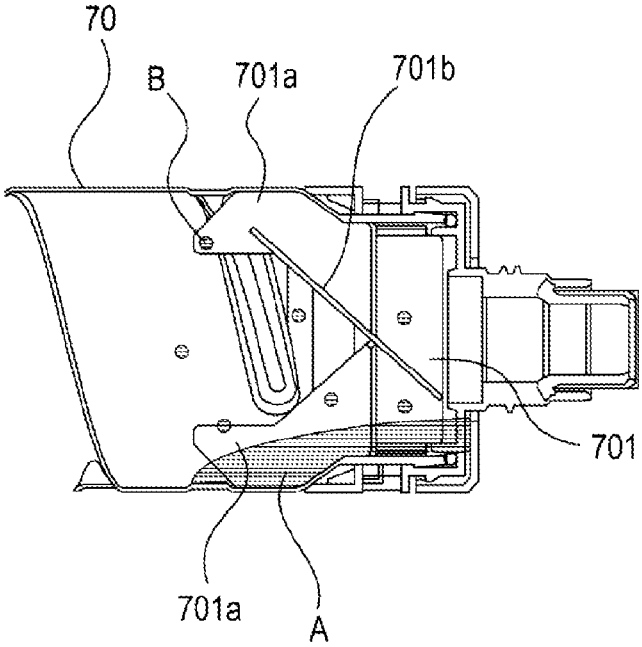

Here, discharging properties of the toner when intermittently rotating the toner bottle 70 will be described with reference to FIGS. 9A and 9B. When the quantity of toner in the toner bottle 70 is small, if the toner bottle 70 is intermittently rotated, the rotation stop time occurs in the toner bottle 70. Accordingly, during the rotation operation of the toner bottle 70, the toner B stirred and floating by the rotation of the toner bottle 70 and the conveying portion 701 falls free, and is deposited in the bottom portion of the toner bottle 70 (FIG. 9A→FIG. 9B).

Even in a case where the total quantity of toner in the toner bottle 70 is equal to that in the case of the continuous rotation, since the percentage of the floating toner B decreases, the toner A accumulated near the opening portion of the toner bottle 70 increases. Moreover, at the time of re-rotation, since the toner accumulated near the discharge opening portion 702 is scooped up by the scooping portion 701*a* of the conveying portion 701, the quantity of the scooped toner becomes larger compared to the case of the continuous rotation. Since the scooped toner slides down the guide portion 701*b* and is conveyed to the discharge opening portion, the quantity of discharge into the toner accommodation portion 302 also increases as compared to the case of the continuous rotation. It is preferred that the stop time of the intermittent rotation be equal to or greater than the time required for the free-fall of the floating toner B, that is, be equal to or greater than the time when the toner falls free by a distance of an inner diameter of the toner bottle 70.

Even when the toner bottle 70 is intermittently rotated for a predetermined time, when the presence of toner is not detected by the toner residual quantity detection portion 401 configured to detect the residual quantity of toner in the toner accommodation portion 302, it is determined that there is no toner in the toner bottle 70. Moreover, in that case, the rotation operation of the toner bottle 70 is stopped, and a display portion (not illustrated) displays to promote the replacement of the toner bottle 70.

Figure 10:
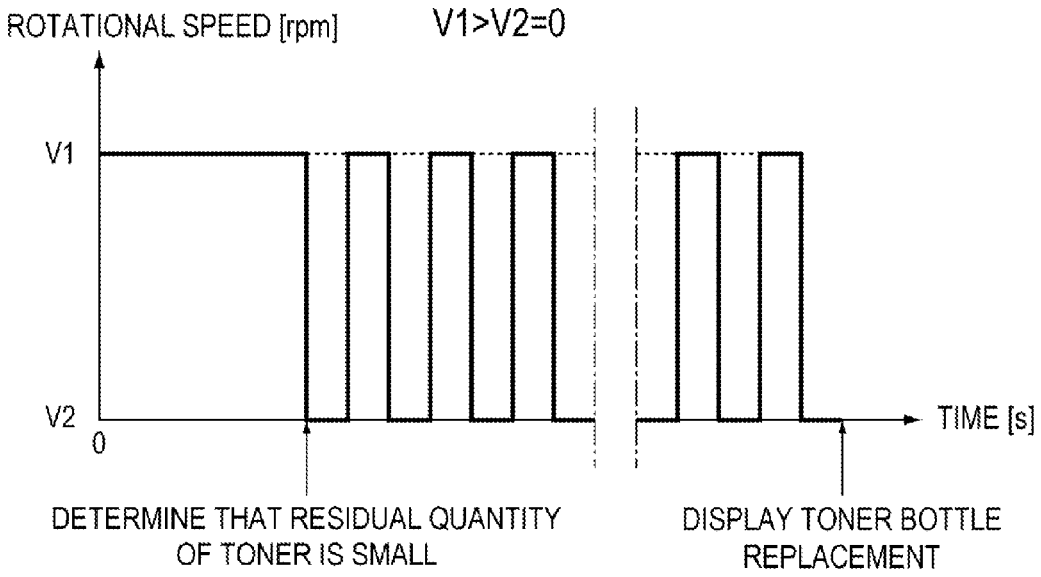
FIG. 10 is an explanatory view of the rotation operation of the toner bottle of a first embodiment.

FIG. 10 illustrates a series of rotation operations of the toner bottle. When the quantity of toner in the toner bottle is large, the continuous rotation is performed (rotational speed V1). When the quantity of toner in the toner bottle decreases, even if the toner bottle continuously rotates for a predetermined time at V1, the presence of toner is not detected by the toner residual quantity detection portion 401. Therefore, it is determined the residual quantity of toner is small, and the toner bottle 70 is switched to the intermittent rotation (rotational speed V2=0). Thereafter, even when the toner bottle 70 is intermittently rotated for a predetermined time, as long as the presence of toner is not detected by the toner residual quantity detection portion 401, the intermittent rotation of the toner bottle 70 is stopped, and the replacement display of the toner bottle is performed.

<Toner Supply Control> Next, a description will be given of a drive control that switches the toner supply mode according to the residual quantity of toner in the toner bottle 70.

Figure 11:
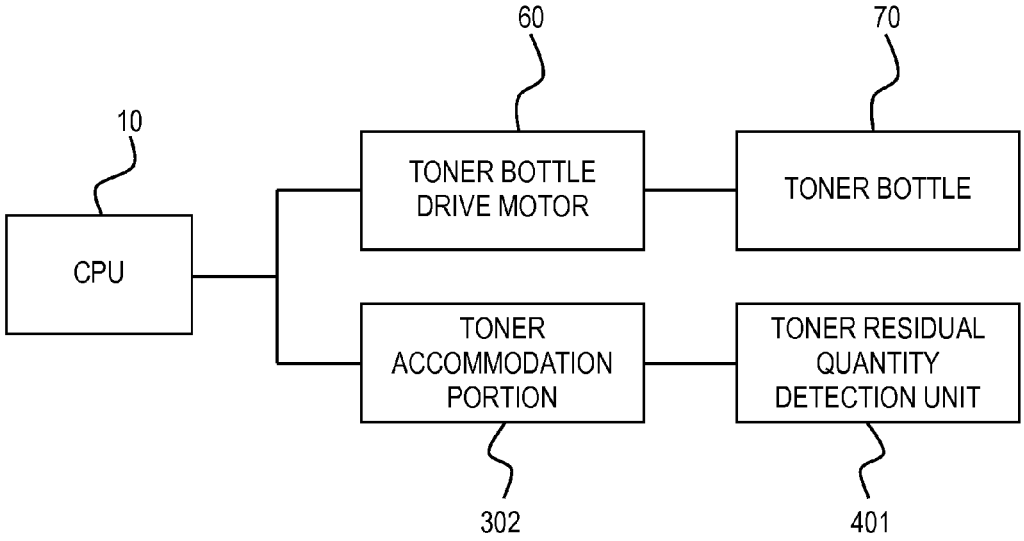
FIG. 11 is a block diagram of the toner supply control.

FIG. 11 is a block diagram of the controller which controls the driving control capable of executing the toner supply in the image forming apparatus of the embodiment. Driving of a toner bottle drive motor 60 serving as a drive portion configured to rotate the toner bottle 70, and the control of the toner residual quantity detection portion 401 in the toner accommodation portion 302 are executed by a CPU 10.

Figure 12:
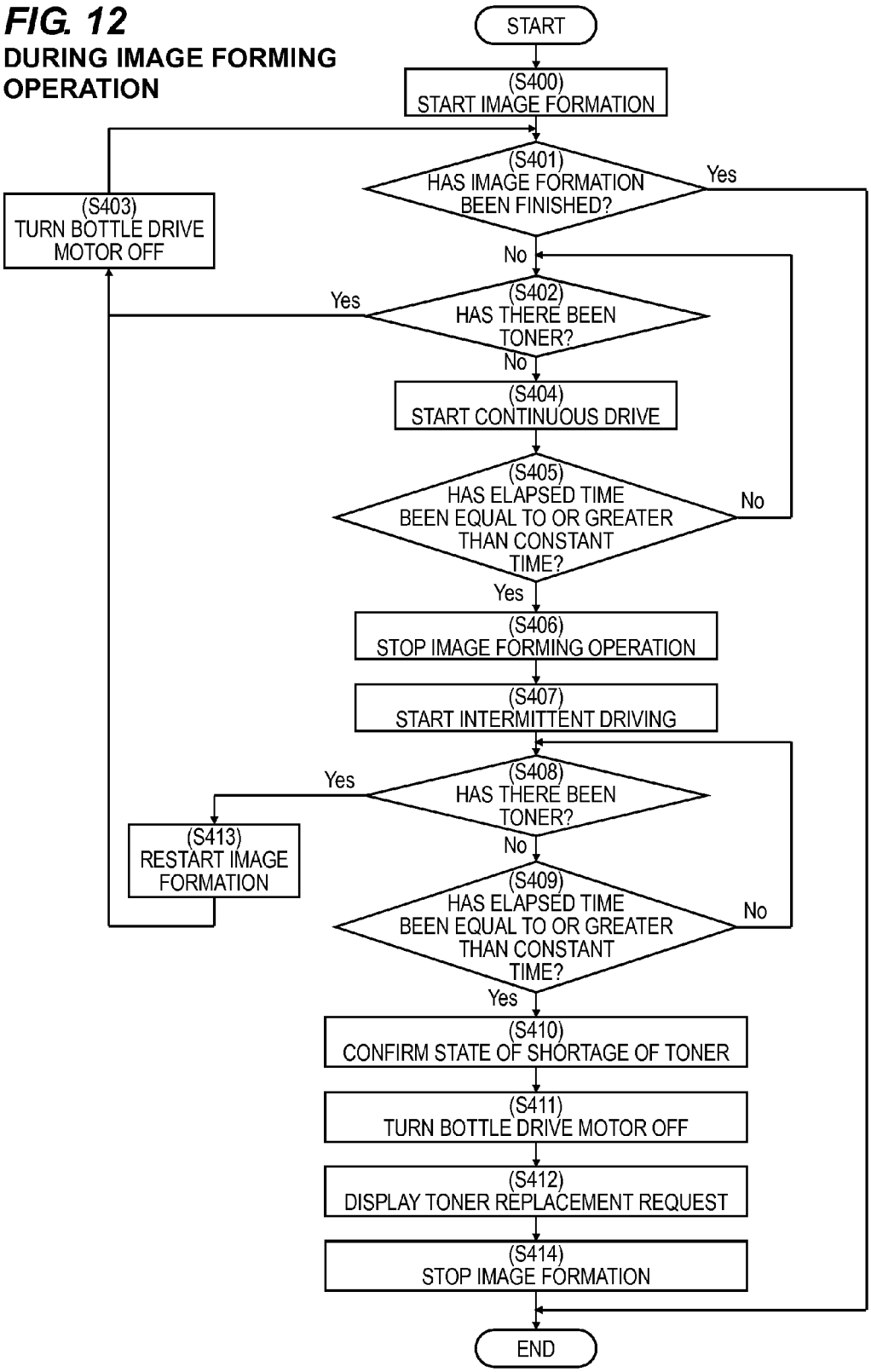
FIG. 12 is a flowchart illustrating the toner supply according to the first embodiment.
Figure 13:
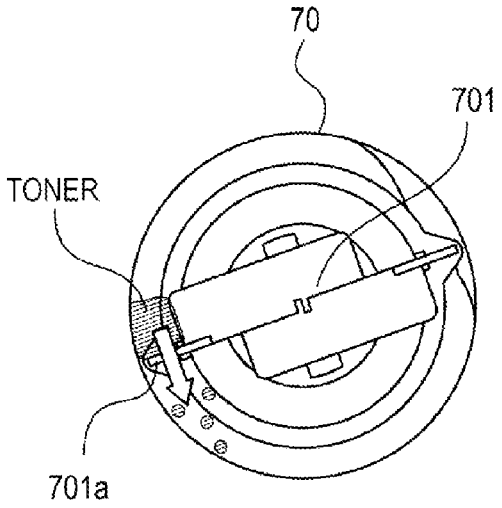
FIG. 13 is an explanatory view illustrating scooping of the toner using the conveying portion.
Figure 14:
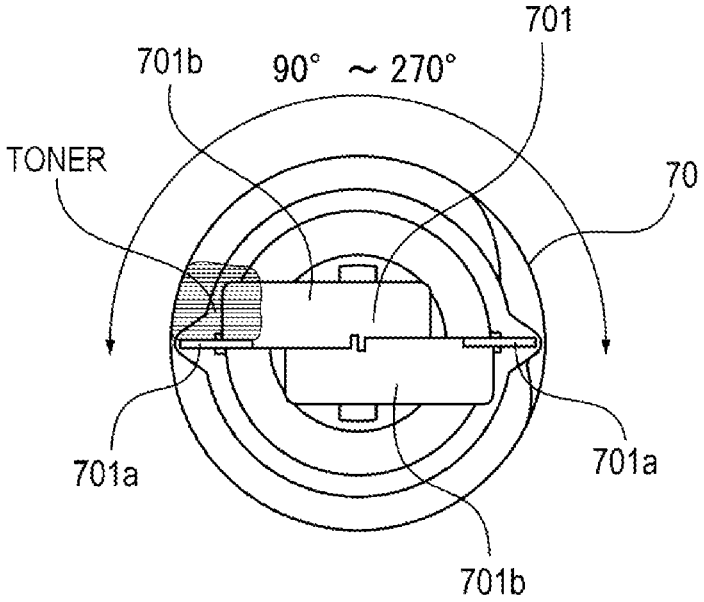
FIG. 14 is an explanatory view of a toner-conveyable region of the conveying portion.
Figure 15:
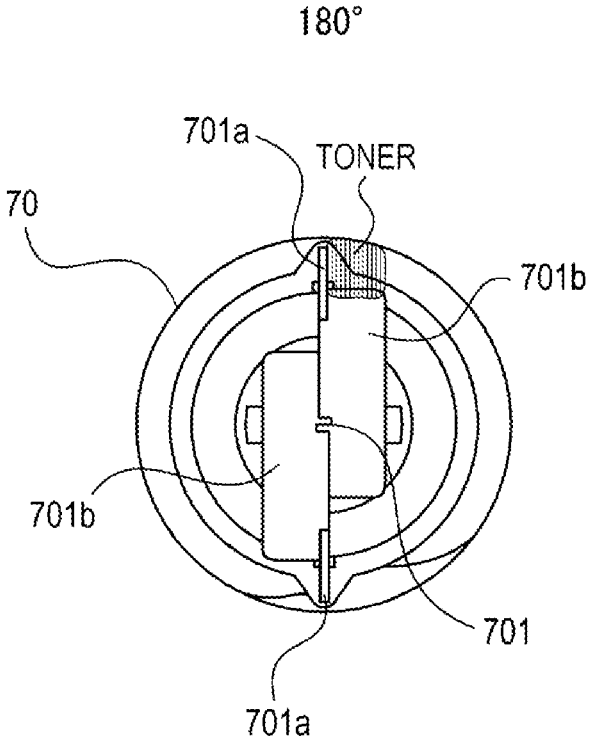
FIG. 15 is an explanatory view of a phase of the conveying portion when the toner discharge efficiency is highest.

FIG. 12 is a flowchart illustrating a toner supply procedure. When an instruction of the image formation is input, the image forming operation is started (S400). When the image forming operation is started, the presence or absence of toner is determined by the toner residual quantity detection portion (S402) until the image forming operation ends (S401). When the shortage of toner is determined, the toner is replenished to the accommodation portion, by rotating the toner bottle (S404) until the presence of toner is determined (S402). When the toner is supplied by the rotation of the toner bottle and the presence of toner is determined by the toner residual quantity detection portion, the rotation of the bottle stops (S403). At this time, since the quantity of toner in the toner bottle is large and the quantity of discharge is large, the replenishment operation is performed which continuously rotates the toner bottle.

In a case where the toner bottle is continuously rotated for a predetermined time or more and the shortage of toner is continuously determined (S405), the image forming operation is stopped (S406). At this time, it is determined that the residual quantity of toner in the toner bottle is small, and the rotation operation of the toner bottle is switched to the intermittent rotation (S407).

When the presence of toner is determined here (S408), the image formation resumes (S413). After the toner bottle is switched to the intermittent rotation, in a case where the toner bottle is intermittently rotated for a predetermined time or more (S409) and the shortage of toner is determined, it is confirmed that the toner bottle is in an empty state (S410). In that case, the intermittent rotation of the toner bottle is stopped (S411), and a replacement request of the toner bottle is displayed on a display portion 501 (S412). Moreover, the image formation is stopped (S414).

When the toner is supplied from the toner bottle 70 as described above, in a case where there is enough toner in the bottle, the toner is supplied by the continuous rotation of the bottle, and in a case where the residual quantity of toner in the bottle is small, the toner is supplied by the intermittent rotation of the bottle. It is possible to efficiently discharge the toner in the bottle, by switching the toner supply mode depending on the residual quantity of toner in the bottle in this way.

In addition, in the embodiment, although the image forming apparatus having the toner accommodation portion (buffer section) 302 configured to store the toner replenished from the toner replenishment container 70 (70*a*, 70*b*, 70*c*, 70*d*) has been described as an example, the invention is not limited thereto. For example, instead of providing the toner accommodation portion (buffer portion) 302, the invention is also applicable to a configuration in which the toner is directly replenished to each developing device 4 from the toner replenishment container 70 (70*a*, 70*b*, 70*c*, 70*d*). In this case, the toner residual quantity detection portion is substitutable for an inductor sensor in the developing device, regardless of the presence or absence of the toner replenishing apparatus. Further, as another substitute portion, a configuration may be provided in which a sensor capable of detecting the presence or absence of the discharge from the toner bottle is provided or the residual quantity is detected based on the video count information. Furthermore, in the case of using the video count information, when the integrated value of the video count information exceeds a predetermined value, it is determined that the residual quantity of toner is small, and the bottle may be switched to the intermittent driving.

[Second Embodiment] In the first embodiment, the description has been given of an example in which, when the quantity of toner in the toner bottle is small, the quantity of toner remaining in the toner bottle is reduced by intermittently rotating the toner bottle. Here, regarding the discharge of toner in the toner bottle, by the rotation of the conveying portion integrally with the rotation of the toner bottle, the toner near the discharge opening portion is scooped up by the scooping portion and can slide down by the guide portion. Accordingly, the rotation time of the toner bottle is related to the discharge efficiency. In the second embodiment, the rotation time during the intermittent rotation of the toner bottle will be described with reference to FIGS. 5A to 5D, 13 and 14.

As described above, in the intermittent rotation of the toner bottle 70, since the toner, which is stirred and floats by the rotation of the toner bottle 70 and the conveying portion 701 during the rotation operation, is deposited in the bottom portion of the toner bottle 70 by free-fall when the rotation is stopped, the toner accumulated near the discharge opening portion 702 also increases. For that reason, when the toner bottle rotates again, the quantity of toner scooped up by the scooping portion 701*a* of the conveying portion 701 increases, the quantity of toner sliding down the guide portion 701*b* also increases, and the quantity of toner conveyed to the discharge opening portion 702 also increases.

As the above-mentioned effect, in particular, during re-rotation, the quantity of toner first scooped up by the scooping portion 701*a* of the conveying portion 701 increases. The quantity of toner, which rotates again and is scooped up after the second time by the scooping portion 701*a* of the conveying portion 701, becomes a situation close to the continuous rotation in the interior of the toner bottle 70. For this reason, there is toner B which is stirred and floats by the rotation of the toner bottle 70 and the conveying portion 701 after the second time, and the toner A accumulated near the opening portion of the toner bottle 70 decreases. Accordingly, the quantity of scooping after the second time becomes less than the quantity of scooping of the first time.

Therefore, for the first time of the re-rotation, it is possible to improve the toner discharging properties of the toner scooped up by the scooping portion 701*a* of the conveying portion 701, by discharging the toner with low loss. That is, as the minimum rotation time of the intermittent rotation, by setting the rotation time to be equal to or greater than the time when the toner first scooped up by the scooping portion 701*a* is able to slide down the guide portion 701*b*, the discharging properties are improved. When the rotation time is equal to or less than that time, even when a lot of toner is scooped up by the scooping portion 701*a* for the first time, the toner is stopped before sliding down the guide portion 701*b*. In this case, when the conveying portion 701 is stopped, the toner is spilled from the upper part of the conveying portion 701 (FIG. 13), a loss increases and the discharging properties are degraded.

To be more specific, as illustrated in FIG. 5A, if the rotational angle of the conveying portion 701 when scooping up the toner by the scooping portion 701*a* is assumed to be 0°, when the rotational angle exceeds 90°, the toner begins to slide down on the guide portion 701*b* (FIG. 5B). Therefore, it is preferable to set the minimum rotation time in the intermittent rotation to the time required for the conveying portion 701 to perform a quarter rotation.

Next, the difference in discharging efficiency due to the posture of the conveying portion 701 when stopping will be described with reference to FIGS. 5A to 5D and 14.

As described above, if the rotational angle of the conveying portion 701 is assumed to be 0° when the scooping portion 701*a* starts to scoop up the toner (FIG. 5A), in a region in which the rotational angle of the conveying portion 701 is 90° to 270° (FIG. 14), the inclination of the guide portion 701*b* forms an angle with respect to the direction of the rotational axis. For this reason, the toner scooped up by the scooping portion 701*a* is able to slide down on the guide portion 701*b*. When stopped in this region, after the stop, since the toner is able to slide down on the guide portion 701*b*, the discharging properties are satisfactory. On the other hand, only when the rotational angle of the conveying portion 701 is stopped at 90° and 270°, since the inclination of the guide portion 701*b* does not form an angle with respect to the direction of the rotational axis, the toner on the guide portion 701*b* cannot slide down, and the toner is not discharged. In other words, the discharging properties are the worst.

Therefore, in the embodiment, the rotation time of the intermittent rotation is set to the time or more required to perform the operation at least once that scoops up the toner by the scooping portion 701*a* and delivers the scooped-up developer is passed to the guide portion. Further, in order to avoid the discharging properties of the toner from the toner bottle 70 from becoming worse, the time is set to the rotation time that prevents the toner bottle 70 from being always stopped in the same phase, and the conveying portion 701 is not always stopped at the rotational angle of 90° and 270°.

Thus, it is possible to increase the quantity of discharge efficiency due to scooping-up and sliding-down of the toner at the time of the intermittent rotation.

[Third Embodiment] Next, a third embodiment will be described below with reference to FIGS. 5A to 5D, and 14 to 16. As described above, when the toner is discharged by the conveying portion 701, the rotational phase is related to the discharging properties. Therefore, in the third embodiment, a protrusion shape (not illustrated) is formed on the exterior of the toner bottle, a photo interrupter (not illustrated) configured to detect the protrusion shape is included, and a phase detection portion is included which detects the phase of the conveying portion 701 by detecting the rotational position of the toner bottle. Moreover, it is possible to directly control the phase of the conveying portion 701 using a detection result of the phase detection portion.

As described in the second embodiment, in order to improve the discharging properties of the toner in the intermittent rotation of the toner bottle 70, it is preferable to continuously perform the scooping-up operation of the toner using the scooping portion 701*a*, and the operation of causing the scooped-up toner to slide down by the guide portion 701*b* once. As illustrated in FIGS. 5A to 5D, after the toner is scooped up by the scooping portion 701*a*, and after the rotational angle of the conveying portion 701 exceeds 90°, the toner starts to slide down by the guide portion 701*b*. In the case of performing the phase control of the conveying portion 701, it is preferable that the rotational angle of the minimum be 90° or more.

Here, a difference in discharging efficiency due to the posture of the conveying portion 701 when the rotation stops will be described. If the rotational angle of the conveying portion 701 when the scooping portion 701*a* starts to scoop up the toner is assumed to be 0°, as described above, in the region in which the rotational angle of the conveying portion 701 is 90° to 270° (FIG. 14), the toner scooped up by the scooping portion 701*a* is able to slide down on the guide portion 701*b*. Therefore, when the conveying portion 701 is stopped in the region, the toner on the guide portion 701*b* efficiently slides down after stopping. In particular, when the rotational angle of the conveying portion 701 is stopped at 180° (FIG. 15), since the inclination of the guide portion 701*b* forms the most angle relative to the direction of the rotational axis, force by which the toner on the guide portion 701*b* slides down is maximized, and the discharge efficiency is the best.

Figure 16A:
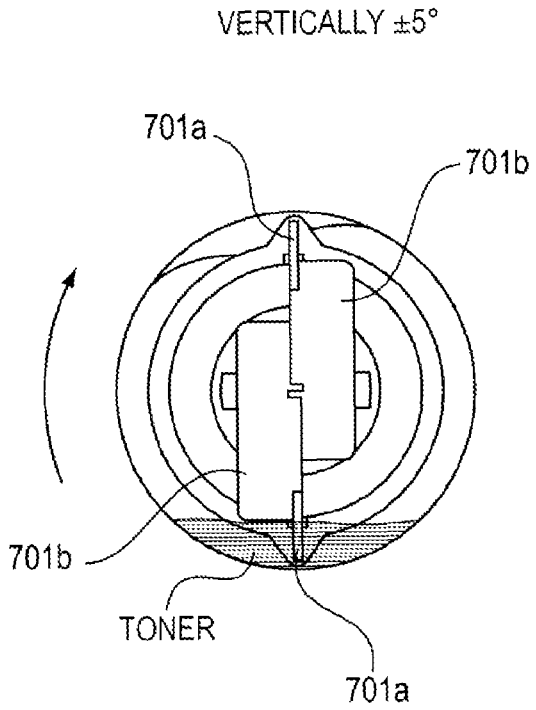
FIGS. 16A and 16B are explanatory views of the rotation operation of the toner bottle of a third embodiment.

Therefore, in the embodiment, the discharge efficiency is improved, by satisfying the minimum angle of rotation at the time of intermittent rotation of the toner bottle 70, and by performing the phase control of the conveying portion 701 so that the guide portion 701*b* enters a position where the toner is guided substantially vertically and downward (for example, ±5° when stopping (FIG. 16A).

Figure 16B:
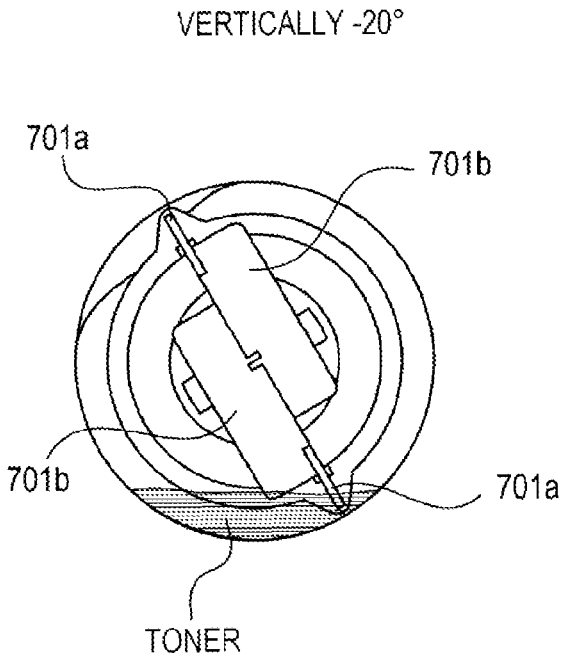

Alternatively, as illustrated in FIG. 16B, when the intermittent rotation of the toner bottle 70 stops, the stop phase of the conveying portion 701 is controlled so that the scooping portion 701*a* enters a position of the upstream side (for example, approximately, −20° in the rotational direction slightly than the vertical direction. Thus, when the toner bottle rotates again, the quantity of toner scooped up by the scooping portion 701*a* increases compared to a case where the scooping portion 701*a* stops in the vertical direction, and even when the toner bottle stops, since the toner on the guide portion 701*b* can slide down, the discharge efficiency is satisfactory. However, in the case of the embodiment, since the guide portion 701*b* is not in the vertical direction when stopping, the discharge efficiency when stopping is lower than the case of stopping in the vertical direction. However, since the quantity of scooping-up the toner increases accordingly, the toner discharge efficiency is satisfactory.

In addition, a unit configured to detect the phase of the conveying portion 701 needs not to be limited to the above-mentioned configuration, and other configurations may be adopted.

Figure 17:
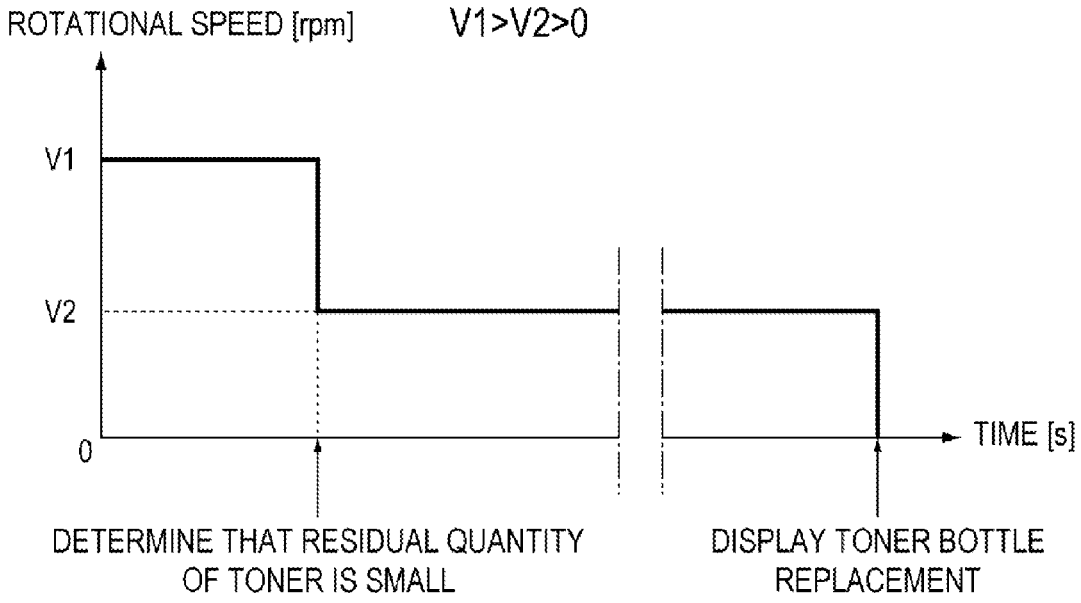
FIG. 17 is an explanatory view of the rotation operation of the toner bottle of a fourth embodiment.

[Fourth Embodiment] In the first embodiment, the description has been given of a case where, when the residual quantity of toner in the toner bottle 70 decreases, by switching the toner bottle 70 from the continuous rotation to the intermittent rotation, it is possible to reduce the quantity of toner remaining in the toner bottle 70. This is greatly influenced by the fact that the interval of the continuous scooping operation using the scooping portion 701*a* of the toner conveying portion 701 becomes longer, and even in the continuous rotation, the rotation operation of the toner bottle 70 can slow down compared to a case where the quantity of toner in the toner bottle is large. Therefore, in the fourth embodiment, the case of performing the continuous constant speed rotation at a low speed when the residual quantity of toner in the toner bottle 70 is small will be described with reference to FIG. 17.

In the embodiment, when the quantity of toner in the toner bottle is large, the continuous rotation (rotational speed V1 [rpm]) is performed. When the quantity of toner in the toner bottle decreases, even when the toner bottle continuously rotates at a rotational speed of V1 for a predetermined time, since the presence of toner is not detected by the toner residual quantity detection portion 401, it is determined that the residual quantity of toner is small, and the toner bottle 70 is switched to the low-speed continuous rotation (rotational speed V2 [rpm]). In addition, there is a relation of V2<V1.

Discharging properties of the toner when continuously rotating the toner bottle at the rotational speed V2 will be described with reference to FIGS. 9A and 9B. As the toner in the toner bottle, there is toner that is stirred and floats by the rotation of the toner bottle 70 and the conveying portion 701. However, since the rotational speed V2 is slower than the rotational speed V1, toner intensity being stirred within the toner bottle becomes weaker than the case of the rotational speed V1, and the toner floating in the toner bottle is reduced. As a result, the toner accumulated near the discharge opening portion increases compared to the case of the rotational speed V1, and the quantity of toner scooped up by the scooping portion 701*a* increases. Accordingly, the quantity of toner sliding down the guide portion 701*b* increases, and the quantity of discharge also increases. Furthermore, at the time of rotational speed V2, since the rotational speed is slower than the case of the rotational speed V1, the time when the toner is present in the region in which the toner can slide down the guide portion 701*b* becomes longer as compared to the case of the rotational speed V1. For this reason, even in the case where the quantity of toner scooped up by the scooping portion 701*a* is equal to the case of the rotational speed V1, the quantity of discharge increases.

Even when the toner bottle is continuously rotated at V2 for a predetermined time, if the presence of toner is not detected by the toner residual quantity detection portion 401, the rotation of the toner bottle is stopped, and the replacement display of the toner bottle is performed.

Figure 18:
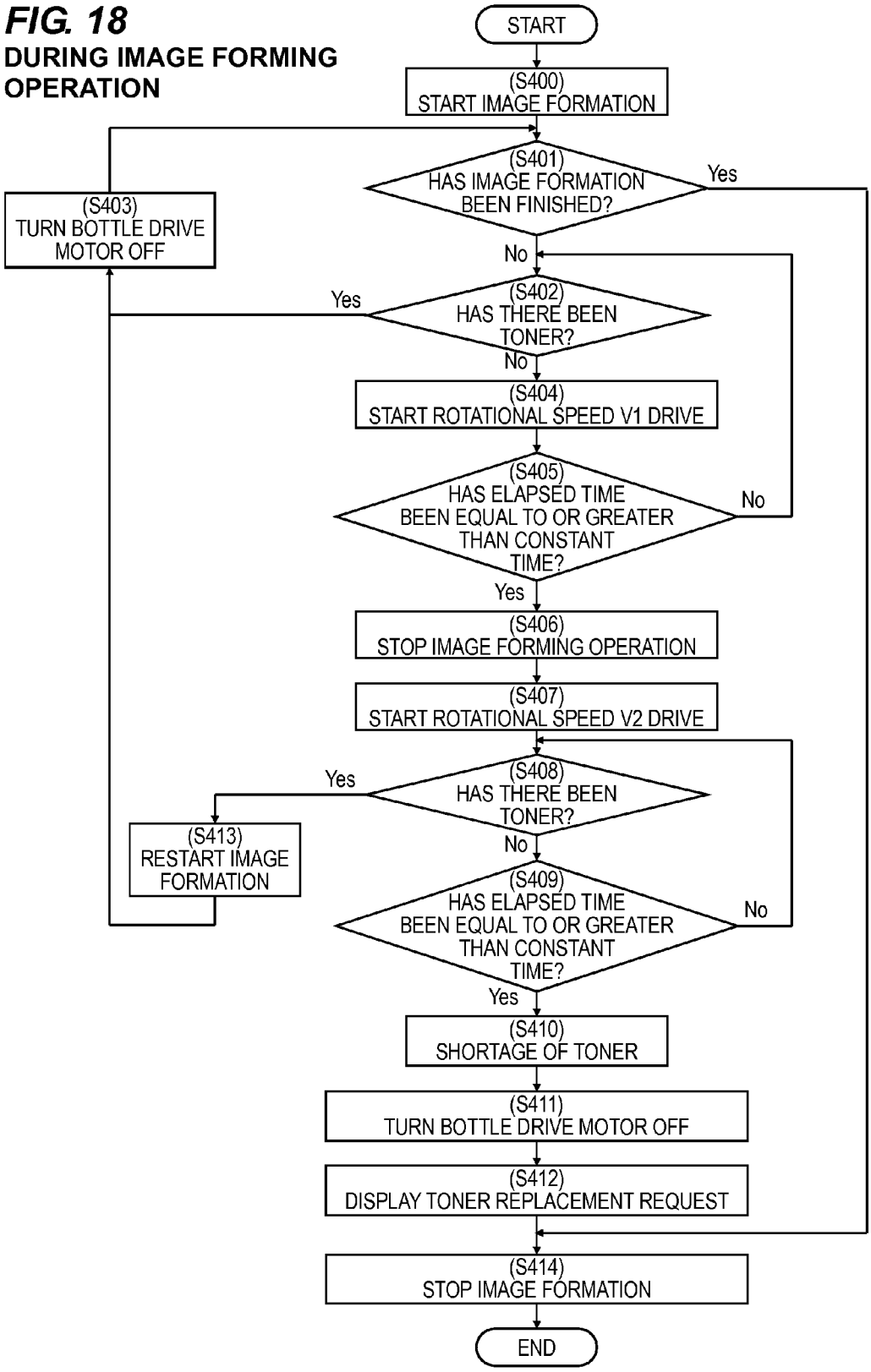
FIG. 18 is a flowchart illustrating the toner supply of the fourth embodiment.

FIG. 18 is a flowchart illustrating the toner supply procedure of the embodiment. In the flowchart, the difference between the flowchart of FIG. 18 and the flowchart of FIG. 12 described in the first embodiment is step S404 and step S407, and the others are identical. That is, in the embodiment, the toner bottle is continuously rotated at the rotational speed V1 in a first supply mode in step S404, and the toner bottle is continuously rotated at a rotational speed V2 in a second supply mode in step S407.

As described above, it is possible to obtain an effect similar to the embodiment described above, by continuously rotating the toner bottle 70 at the rotational speed V1 in the first supply mode, and by continuously rotating the toner bottle 70 at the rotational speed V2 slower than V1 as the second supply mode when the residual quantity of toner is small. Moreover, in the embodiment, since the toner bottle is continuously rotated in both first supply mode and second supply mode, the drive control becomes easier than the case of the intermittent rotation.

Figure 19:
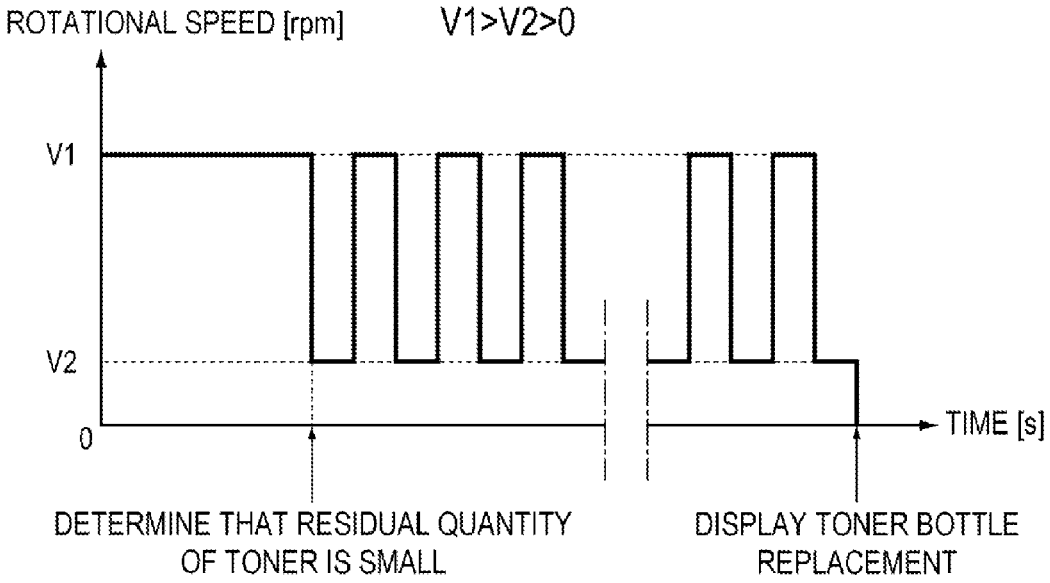
FIG. 19 is an explanatory view of the rotation operation of the toner bottle of a fifth embodiment.

[Fifth Embodiment] When the residual quantity of toner in the toner bottle decreases as in the above-mentioned embodiment, the reason for switching the toner bottle to the intermittent rotation is that the operation is influenced by the increase in the interval of the continuous scooping operation using the scooping portion of the toner conveying portion. The rotation operation of the toner bottle can be performed by the continuous shift rotation compared to a case where the quantity of toner in the toner bottle is large. In the fifth embodiment, the case of performing the continuous shift rotation when the residual quantity of toner in the toner bottle is small will be described with reference to FIG. 19.

When the quantity of toner in the toner bottle is large, the continuous rotation is performed (rotational speed V1). When the quantity of toner in the toner bottle decreases, even when the continuous rotation is performed at V1 for a predetermined time, since the presence of toner is not detected by the toner residual quantity detection portion, it is determined that the residual quantity of toner is small, and the toner bottle is switched to the continuous shift rotation. Here, the continuous shift rotation means that the toner bottle periodically repeats the rotation of the rotational speeds V1 and V2 (<V1).

Moreover, in a case where the shortage of toner is continuously detected for a predetermined time, the rotation is stopped.

Figure 20:
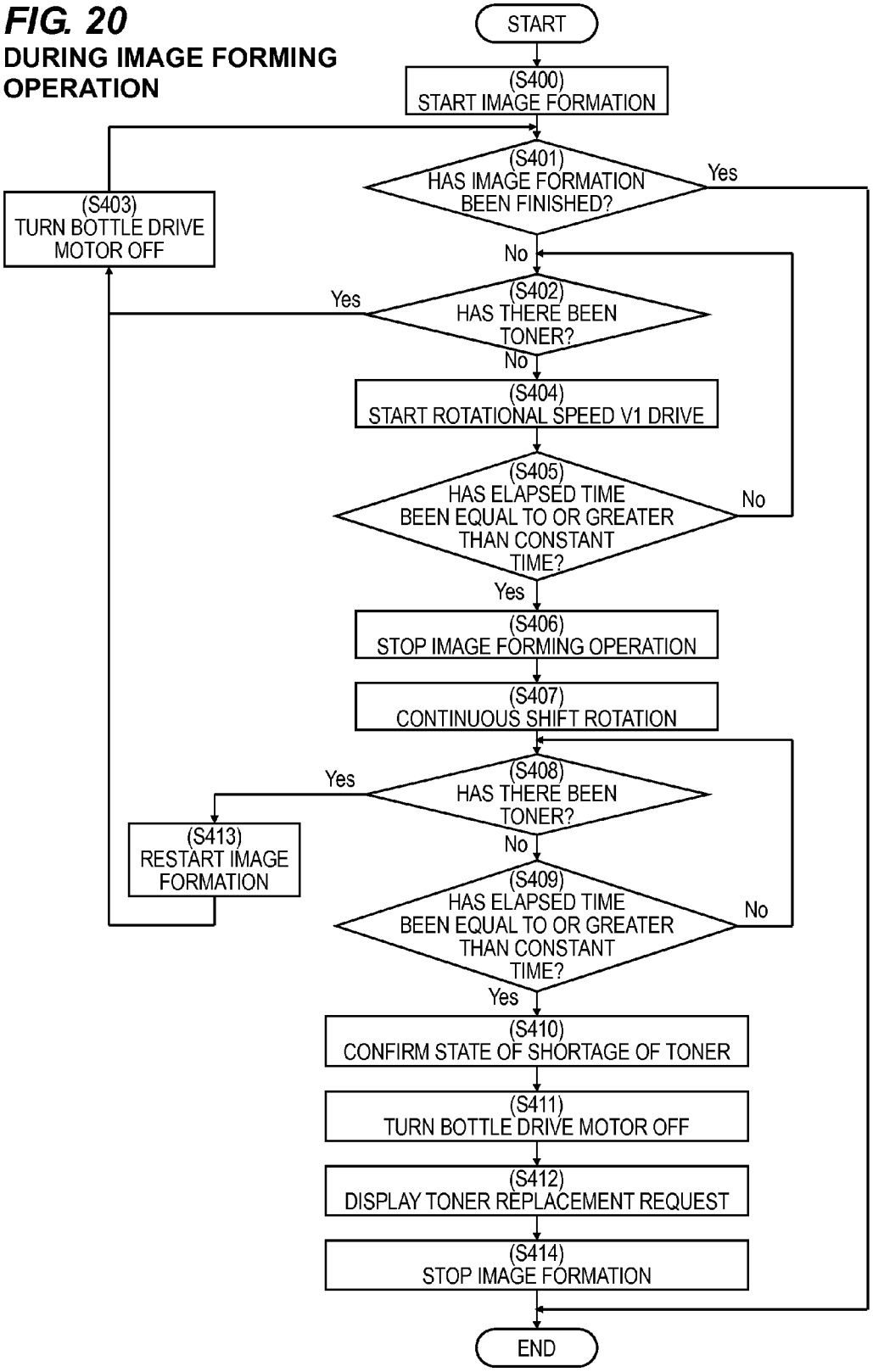
FIG. 20 is a flowchart illustrating the toner supply of the fifth embodiment.

FIG. 20 is a flowchart illustrating the toner supply procedure of the embodiment. In the flowchart, the difference between the flowchart of FIG. 20 and the flow chart of FIG. 18 described in the fourth embodiment is step S407, and the others are identical. That is, in the embodiment, the continuous rotation is performed in the first supply mode at the rotational speed V1 as in the fourth embodiment, but the continuous shift rotation is performed in the second supply mode in step S407.

As described above, it is possible to obtain an effect similar to the embodiment described above, by continuously rotating the toner bottle 70 at the rotational speed V1 in the first supply mode, and by performing the continuous shift rotation that continuously switches the rotational speeds V1 and V2 as the second supply mode when the residual quantity of toner is small.

[Sixth Embodiment] Next, a sixth embodiment will be described. The embodiment is characterized by a method of detecting the residual quantity of toner, when intermittently rotating the toner bottle as the second supply mode at the time of toner supply.

<Toner Residual Quantity Detection> In describing the embodiment, first, a process will be described in which the toner supplied to the toner accommodation portion 302 by the rotation of the toner bottle 70 is detected by the toner residual quantity detection portion 401.

Figure 21:
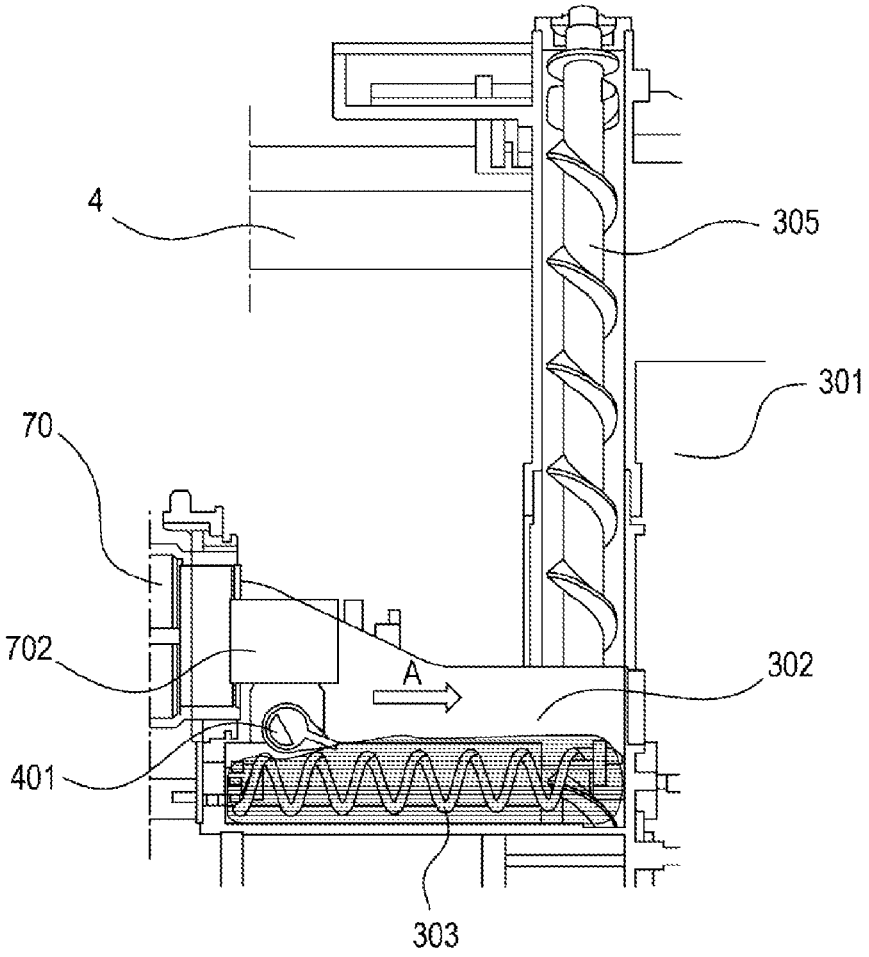
FIG. 21 is an explanatory view of the toner conveyance of the toner replenishing apparatus.

FIG. 21 is a cross-sectional view of the toner replenishing apparatus 301 illustrating the flow of the toner supply. When the toner in the developing device 4 is consumed by copying, the print job and the like, and the toner in the developing device 4 is reduced, the toner conveying member 305 in the toner replenishing apparatus 301 rotates by the replenishment request signal, and the toner is replenished to the developing device 4. The toner conveying member 303 is also operated at the same time as the rotation of the toner bottle 70 to convey the toner in the toner accommodation portion 302 in the direction of arrow A.

When the toner in the toner accommodation portion 302 is conveyed in the direction of arrow A, the height of the toner powder surface of the upstream side (portion of the vicinity of the toner residual quantity detection portion 401) of the toner conveying member 303 is lowered, and the "shortage of toner" is detected by the toner residual quantity detection portion 401. When the toner residual quantity detection portion 401 detects the "shortage of toner", a toner bottle drive portion (not illustrated) is operated, and the toner bottle 70 rotates. When the toner bottle 70 rotates, the toner in the bottle is discharged from the toner discharge opening portion 702, falls free, and is deposited in the toner accommodation portion 302 directly below the discharge opening portion 702 as described above.

The toner deposited in the toner accommodation portion 302 is conveyed in the direction of arrow A while the powder surface is leveled, by the toner conveying member 303 operating together with rotation of the toner bottle 70. At the same time, the height of the toner powder surface in the toner accommodation portion 302 is detected by the toner residual quantity detection portion 401, and when the height of the toner powder surface reaches a predetermined height, the "presence of toner" is detected to stop driving of the toner bottle 70 and the toner conveying member 303. At this time, the "presence of toner" determination time using the toner residual quantity detection portion 401 is preferably set to be shorter in order to prevent the excessive replenishment of toner, and is approximately 100 ms in the embodiment.

By repeating the above operation, it is possible to substantially constantly maintain the density of toner in the toner accommodation portion 302, and it is possible to quantitatively replenish the toner to the developing device 4.

Figure 22:
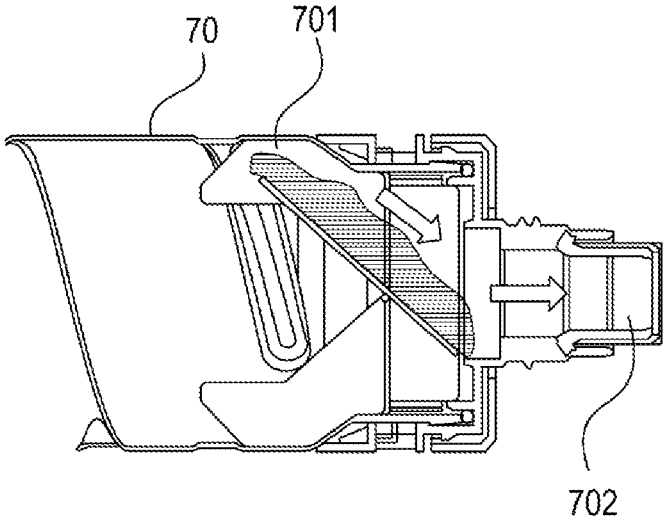
FIG. 22 is an explanatory view of the toner conveyance of the toner bottle.
Figure 23:
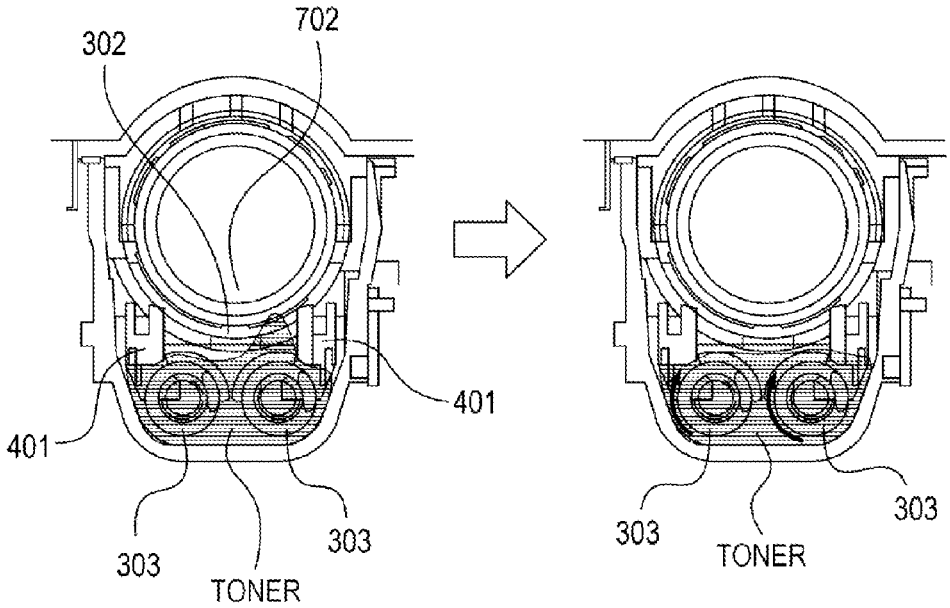
FIG. 23 is a view illustrating the behavior of the toner of the interior of the toner replenishing apparatus.

<Toner Residual Quantity Determination Time> Next, the toner discharge when the toner bottle 70 rotates intermittently, and the method of detecting the toner residual quantity detection portion 401 will be described with reference to FIGS. 22 to 25. FIG. 22 is a cross-sectional view of the toner bottle 70, and FIG. 23 is a cross-sectional view of the toner replenishing apparatus 301 as viewed from the toner bottle 70 side.

In a case where the residual quantity of toner in the toner bottle 70 is lowered, the toner supply mode becomes the second supply mode, and the toner bottle 70 intermittently rotates, during the rotation of the toner bottle 70, the toner is discharged from the discharge opening portion 702 of the toner bottle 70 as described above. At this time, when the toner bottle 70 rotates, as illustrated in FIG. 23, the discharged toner is deposited unevenly in the toner accommodation portion 302, but the toner is conveyed by the toner conveying member 303 operating together with the toner bottle 70, and toner powder surface is leveled. Thereafter, the height of the toner powder surface in the toner accommodation portion 302 is detected by the toner residual quantity detection portion 401, and when the height of the toner powder surface reaches a predetermined height, the "presence of toner" is detected to stop driving of the toner bottle (not illustrated) and the toner conveying member 303.

Figure 24:
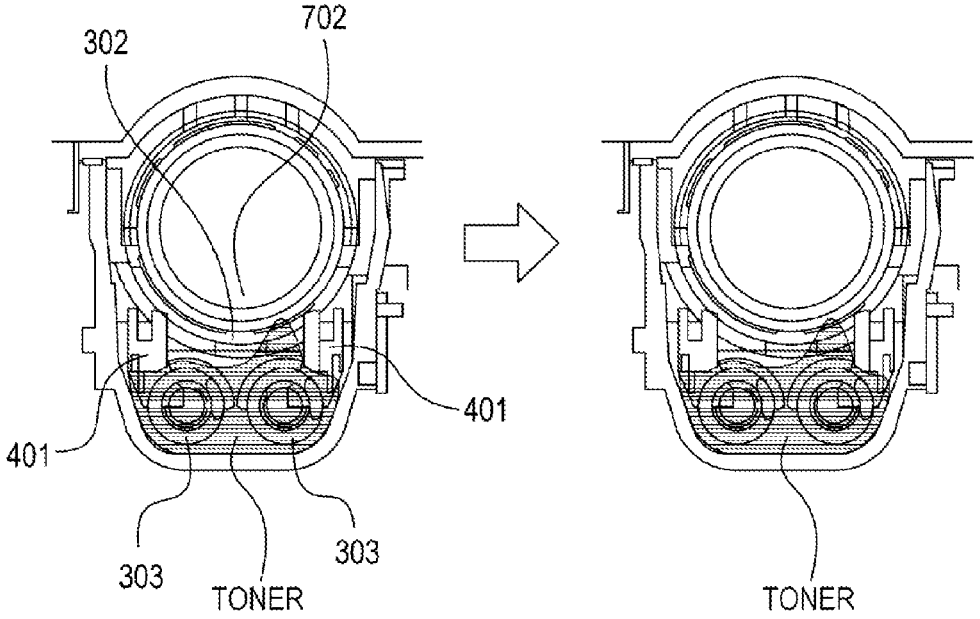
FIG. 24 is a view illustrating the behavior of the toner of the interior of the toner replenishing apparatus.

On the other hand, during stop of the toner bottle 70, since the conveying portion 701 also stops, the toner of the bottom portion in the toner bottle 70 is not scooped up, but the toner deposited in the guide portion of the conveying portion 701 slides down the guide portion 701*b* and is discharged from the discharge opening portion 702. That is, the toner is discharged even after the toner bottle 70 stops. That is, as illustrated in FIG. 24, the discharged toner is deposited unevenly in the toner accommodation portion 302. However, since the toner bottle 70 stops, the toner conveying member 303 operating together with rotation of the toner bottle also stops, and the toner deposited unevenly in the toner accommodation portion 302 is held in that state.

In a case where the toner residual quantity detection portion 401 is an optical detection type, when the toner deposited unevenly shields a part of the light transmitting portion, even in a case where the quantity of toner in the toner accommodation portion 302 is small, the "presence of toner' is detected. When the quantity of toner in the toner accommodation portion 302 decreases, the toner density in the toner accommodation portion 302 drops, the quantitative replenishment of the toner to the developing device 4 cannot be performed, and the ratio of the toner in the developing device 4 changes, which may lead to an image failure and an error.

Figure 25:
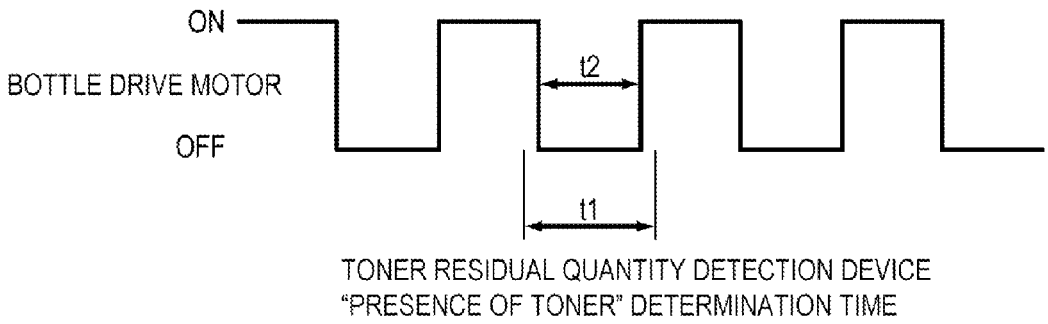
FIG. 25 is an explanatory view of a determination time using a developer detection portion.

Therefore, in the embodiment, as illustrated in FIG. 25, the "presence of toner" determination time t1 using the toner residual quantity detection portion 401 is set to be longer than a stop time t2 of the intermittent rotation of the toner bottle 70 (t1>t2). In this manner, since the toner conveying member 303 is necessarily operated during the "presence of toner" determination time and the toner powder surface deposited unevenly in the toner accommodation portion 302 is leveled, it is possible to detect the stable "presence of toner" by the toner residual quantity detection portion 401.

In addition, in the embodiment, the stop time t2 of the intermittent rotation of the toner bottle 70 is 1800 ms, whereas the "presence of toner" determination time t1 using the toner residual quantity detection portion 401 is 2200 ms.

As described above, in a case where the toner bottle 70 is intermittently rotated, by setting the "presence of toner" determination time t1 of the toner residual quantity detection portion to be longer than the stop time t2 of the toner bottle intermittent rotation, it is possible to stabilize the quantity of toner in the toner accommodation portion. As a result, since the quantity of toner supplied to the developing device from the toner replenishing device is also stabilized, it is possible to prevent the occurrence of a defective image or an error.

In addition, in the embodiment, as a method of detecting the residual quantity of toner, the optical sensor type is described, but the same also applies to the case of detecting the height of the toner powder surface by a piezoelectric sensor type or the like.

In the embodiment, an example has been described in which the toner bottle 70 is continuously rotated at the time of the first mode as the normal replenishment operation (when the quantity of toner in the toner bottle is large), but the invention is not limited thereto. For example, a configuration that performs the intermittent replenishment even at the normal time may be adopted within the range in which the effects of the invention are obtained. In other words, as long as the second supply mode has the quantity of rotation per unit time less than the first supply mode, needless to say, a configuration may be adopted in which the intermittent driving is performed even in the drive conditions of the first supply mode. In this case, it is preferable to increase the frequency of stop during the intermittent driving in the second supply mode compared to the first supply mode in view of the discharge efficiency. Furthermore, needless to say, it may cope with the operation by changing the speed during rotation at the time of the intermittent driving the first and second modes. Furthermore, it may cope with the operation by shortening the drive ON time during the bottle intermittent operation. Of course, the configurations and the embodiments described above may be combined with one another without departing from the effects of the invention.

According to the invention, since there is a plurality of developer supply modes from the container main body, for example, when the quantity of developer in the container decreases, it is possible to efficiently move the developer in the container to the opening portion, by switching the mode to the second supply mode to reduce the quantity of rotation of the container per unit time. Thus, it is possible to reduce the quantity of developer remaining in the container, without incurring the costs.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-202948, filed Sep. 14, 2012, and No. 2013-155213, filed Jul. 26, 2013, which are hereby incorporated by reference herein in their entirety.

What is claimed is:

1. A developer replenishing apparatus comprising:

a rotatable developer supply container configured to supply developer, said container having an opening provided in an axial end portion thereof and configured to permit discharging of the developer therein;

a scoop portion provided in said container and configured to scoop the developer in said container with a rotation of said container;

a guide portion provided in said container and configured to guide the developer scooped by said scoop portion toward said opening;

a driving portion configured to rotationally drive said container;

a developer receiving portion configured to receive the developer discharged through said opening from said container;

a detecting portion configured to detect a developer amount in said developer receiving portion; and a control portion configured to control said driving portion based on an output of said detecting portion, wherein when the developer amount detected by said detecting portion is smaller than a predetermined amount even if said control portion rotates said container continuously in a first driving condition in a first predetermined time period, said control portion rotates said container intermittently in a second driving condition in which a quantity of rotation of the container per unit time is less than the first driving condition, and then when the developer amount detected by said detecting portion is smaller than the predetermined amount even if said control portion rotates said container intermittently in the second driving condition in a second predetermined time period, said control portion indicates an exchange of said container.

2. A developer replenishing apparatus comprising:

a rotatable developer supply container configured to supply developer, said container having an opening provided in an axial end portion thereof and configured to permit discharging of the developer therein;

a scoop portion provided in said container and configured to scoop the developer in said container with a rotation of said container;

a guide portion provided in said container and configured to guide the developer scooped by said scoop portion toward said opening;

a driving portion configured to rotationally drive said container;

a developer receiving portion configured to receive the developer discharged through said opening from said container;

a detecting portion configured to detect developer in said developer receiving portion; and a control portion configured to control said driving portion based on an output of said detecting portion, wherein the control portion executes a first mode in which the container is continuously driven, and a second mode in which the container is intermittently driven, and the controller switches from the first mode to the second mode, based on the detection result of the detection portion.

3. A developer replenishing apparatus comprising:

a rotatable developer supply container configured to supply developer, said container having an opening provided in an axial end portion thereof and configured to permit discharging of the developer therein;

a scoop portion provided in said container and configured to scoop the developer in said container with a rotation of said container;

a guide portion provided in said container and configured to guide the developer scooped by said scoop portion toward said opening;

a driving portion configured to rotationally drive said container;

a developer receiving portion configured to receive the developer discharged through said opening from said container;

a detecting portion configured to detect developer in said developer receiving portion; and a control portion configured to control said driving portion based on an output of said detecting portion, wherein the control portion executes a first mode in which the container is continuously driven, and a second mode in which the container is driven by switching the rotational speed periodically, and the controller switches from the first mode to the second mode, based on the detection result of the detection portion.

* * * * *